US005481337A

United States Patent [19]

Tsuchiya et al.

[11] Patent Number: 5,481,337

[45] Date of Patent: Jan. 2, 1996

[54] METHOD AND APPARATUS FOR CORRECTING IMAGE FORMATION IN ACCORDANCE WITH A POTENTIAL MEASUREMENT AND A DENSITY MEASUREMENT SELECTED ALONG AN AXIAL DIRECTION OF A PHOTOSENSITIVE DRUM

[75] Inventors: Hiroaki Tsuchiya; Tetsuhiro Shibayama, both of Yokohama; Toru Katsumi, Kawasaki; Yuji Kamiya, Yokohama, all of Japan

[73] Assignee: Canon Kabushiki Kaisha, Tokyo, Japan

[21] Appl. No.: 881,882

[22] Filed: May 12, 1992

[30] Foreign Application Priority Data

| | | | |
|---|---|---|---|
| May 13, 1991 | [JP] | Japan | 3-107170 |
| Aug. 2, 1991 | [JP] | Japan | 3-216540 |
| Aug. 29, 1991 | [JP] | Japan | 3-244417 |
| Oct. 15, 1991 | [JP] | Japan | 3-295140 |
| Oct. 15, 1991 | [JP] | Japan | 3-295141 |

[51] Int. Cl.[6] ..... G03G 21/00

[52] U.S. Cl. ..... 355/208; 347/130; 347/140; 355/205; 355/207

[58] Field of Search ..... 355/219, 221, 355/205, 207, 246, 208; 346/160, 160.1; 347/140, 130

[56] References Cited

U.S. PATENT DOCUMENTS

| | | | |
|---|---|---|---|
| 4,474,453 | 10/1984 | Yanagawa et al. | 355/214 X |
| 4,748,465 | 5/1988 | Tsilibes et al. | 346/160 |
| 4,860,048 | 8/1989 | Itoh et al. | 355/208 |
| 5,060,013 | 10/1991 | Spence | 355/208 |
| 5,081,492 | 1/1992 | Hammond | 355/208 |
| 5,250,988 | 10/1993 | Matsuura et al. | 355/208 |

FOREIGN PATENT DOCUMENTS

| | | |
|---|---|---|
| 60-59376 | 4/1985 | Japan . |
| 2-179659 | 7/1990 | Japan . |
| 2-267572 | 11/1990 | Japan . |
| 2-275479 | 11/1990 | Japan . |
| 3-119377 | 5/1991 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

In an electrophotographic image forming apparatus, a potential measurement device for measuring the surface potential of the electrostatic latent image and a reflective density measurement device for measuring the density of a visible image developed from the latent image are made movable, in mutually synchronized manner, along the axial direction of the rotating photosensitive member. In this manner the image forming ability can be measured over the entire surface of the photosensitive member, and the process conditions can be suitably regulated according to the results of measurements.

23 Claims, 36 Drawing Sheets

ADJUSTMENT
MEASURE AXIAL POTENTIAL
40
41
NG
AVERAGE VALUE OK ?
OK
42
RIPPLE OK ?
NG
GENERATE ALARM3
OK
TURN ON DEVELOPMENT DEVICE
43
ADJUSTMENT
MEASURE AXIAL DENSITY
44
45
NG
AVERAGE VALUE OK ?
OK
46
RIPPLE OK ?
NG
GENERATE ALARM4
OK
TURN OFF DEVELOPMENT DEVICE
47
A

FIG. 5

| | | ALARM ON/OFF | | | | | | | | |
|---|---|---|---|---|---|---|---|---|---|---|
| ALARM1 | | ON | OFF | OFF | OFF | OFF | ON | OFF | OFF | OFF |
| ALARM2 | | ↑ | ON | ↑ | ↑ | ↑ | ↑ | ON | ↑ | ↑ |
| ALARM3 | | ↑ | ↑ | ON | ↑ | ↑ | ↑ | ↑ | ON | ↑ |
| ALARM4 | | ↑ | ↑ | ↑ | ↑ | ↑ | ↑ | ↑ | ↑ | ↑ |
| ALARM5 | | ↑ | ↑ | ↑ | ON | ↑ | ↑ | ↑ | ↑ | ON |
| ALARM6 | | ↑ | ↑ | ↑ | ↑ | ↑ | ↑ | ↑ | ↑ | ↑ |
| ALARM7 | | ↑ | ↑ | ↑ | ↑ | ON | OFF | OFF | OFF | OFF |
| MAINTENANCE ITEMS | C | ◎ | | | | | ◎ | | | |
| | O | ○ | ○ | ◎ | ○ | | ○ | ○ | ◎ | ○ |
| | D | ○ | ◎ | ○ | ◎ | | ○ | ◎ | ○ | ◎ |
| | T | ○ | ○ | ○ | ○ | ◎ | | | | |

C : CHARGE DEVICE
O : EXPOSURE DEVICE
D : DEVELOPMENT DEVICE
T : TRANSFER DEVICE
◎ : ABNORMALITY
○ : CHECK NECESSARY

METHOD AND APPARATUS FOR CORRECTING IMAGE FORMATION IN ACCORDANCE WITH A POTENTIAL MEASUREMENT AND A DENSITY MEASUREMENT SELECTED ALONG AN AXIAL DIRECTION OF A PHOTOSENSITIVE DRUM

BACKGROUND OF THE INVENTION

1. Field of the Invention

The present invention relates to an image forming apparatus, and more particularly to an image forming apparatus capable of optimizing the image forming conditions.

2. Related Background Art

Electrophotographic copying machine is already well known as an image forming apparatus.

Such copying machine is equipped therein with a cylindrical photosensitive drum, bearing a photosensitive layer on the external periphery thereof, and said photosensitive drum is driven in a predetermined direction by driving means. Along the periphery of said photosensitive drum, there are provided, in succession along the direction of rotation, primary charging means, exposure means, developing means, image transfer means, cleaning means and charge eliminating means.

In such configuration, the external periphery of the photosensitive drum is charged to a predetermined potential by the primary charger, and thus charged portion is exposed by the exposure means along with the rotation of the photosensitive drum. The surface potential of the external periphery of the photosensitive drum varies according to the amount of exposure to light, whereby an electrostatic latent image is formed in continuation on said external periphery. Said electrostatic latent image is rendered visible by deposition of toner from the developing means, and the visible image thus formed is transferred, by the image transfer means, onto a sheet material. The toner remaining on the photosensitive drum is removed by the cleaning means, and the surface potential is then eliminated by the charge eliminating means.

The image forming apparatus explained above is susceptible to variations in the ambient conditions because of the use of an electrostatic process, and is associated with drawbacks of propensity to cause unevenness in density resulting from uneven charging and an insufficient density resulting from deterioration in the developing ability, and of insufficient durability. These drawbacks result from smear in the primary charger, deterioration of charging ability of the photosensitive drum, deterioration of charging ability of toner etc. For avoiding these drawbacks, there is already known a method of measuring the surface potential of the photosensitive drum with a potential meter and optimizing the amounts of charging and exposure according to the result of said measurement. Also there is known a method of measuring the visible image formed on the photosensitive drum with a reflective densitometer and thus optimizing the developing conditions and the concentration of developer.

However, since the measuring devices in such conventional technologies are fixed in a direction perpendicular to the rotating direction of the photosensitive drum, it is difficult to detect the state of latent or visible image over the entire photosensitive member.

Also in the conventional analog image forming methods, in which the photosensitive member is directly exposed to the light reflected or transmitted by the original image, it is difficult to correct local image defects even if the measurement is conducted in a direction perpendicular to the rotating direction, and such defects can only be made less conspicuous by improvement in the entire level of image.

Furthermore, since the measuring devices are fixed in a direction perpendicular to the rotating direction, there may result erroneous control due to such local detection, though the image optimization is possible on the position of measurement.

Furthermore, since the measurements of potential and reflective density have conventionally been conducted independently, there may be applied an excessive load on the object of control. For example, in case the image density is low while the potential of the latent image is at a target value, the restoration of image density solely by the developing conditions may result in background smear or a long time required for such density restoration.

In the following there will be given an explanation specifically on the corona charger. FIG. 38 is a schematic view of a copying machine, as an example of the image forming apparatus of the above-explained kind. A cylindrical photosensitive member 100 rotates in a direction X, about an unrepresented axis. Around the photosensitive member 100 and along the rotating direction thereof, there are provided, in succession, a corona charger 101 serving as discharge means, developing means 102, a transfer charger 103, a separating charger 104 and cleaning means 105.

In the above-explained configuration, after the surface of the photosensitive member 100 is charged by the corona charger 101, said surface is exposed to a light image Y by unrepresented exposure means, in order to form a latent image. Said latent image is rendered visible by the deposition of toner from the developing means 102, and said toner image is transferred by the transfer charger 103 onto a transfer sheet 106. Said transfer sheet 106 is separated from the photosensitive member 100 by the separating charger 104, while the photosensitive member 100 is subjected to the removal of the remaining toner by the cleaning means 105.

Subsequently the transfer sheet 106 is advanced to an unrepresented fixing unit, for fixing said visible image.

The corona charger 101 is smeared, in the course of repetition of the above-explained copying operation, by the deposition of floating toner generated from the developing means 102, paper dusts, vapor of silicone oil used in the fixing unit, substances produced in the discharge etc. When such contaminating substances are deposited on a discharge wire (extending in the axial direction of the photosensitive member 100), a grid, shields etc. constituting the corona charger 101, the discharge becomes uneven in the direction of said wire, thus resulting in deterioration of the obtained visible image, since such unevenness in discharge results in uneven charging on the photosensitive member 100, thus giving rise to density unevenness or streaks on the visible image. Such smear, when aggravated further, leads eventually to abnormal discharge, which may damage the photosensitive member. For suppressing such smear of the charger 101, there has already been provided an automatic cleaner (not shown), which, for example in case of cleaning the discharge wire, sandwiches said wire with a wiping member for example of felt or sponge and moves along the wire thereby removing the smearing substance from the wire.

However, since such smearing substance sticks firmly to the discharge wire, it cannot be eliminated completely by such cleaning operation and accumulates gradually on the wire after repeated discharges, so that the unevenness in discharge occurs sooner or later. Consequently, the unevenness in discharge can only be eliminated completely by the replacement of the discharge wire. On the other hand, since the developing rate of contamination is heavily dependent on the ambient conditions (temperature, humidity, amount of dust etc.) and the conditions of use (frequency of copying, kind of paper used etc.), it is extremely difficult to predict the number of copies when the unevenness in discharge occurs. For this reason, the discharge wire is replaced after the deterioration in image quality by the discharge unevenness appears, and this situation has resulted in the deterioration of quality of the apparatus.

Besides the photosensitive member has to be replaced if it is damaged by the abnormal discharge, and such replacement not only complicates the maintenance work but also elevates the running cost of the apparatus. Although the deterioration of image can be prevented by the wire replacement prior to the appearance of uneven discharge, such wire replacement has generally to be conducted amply before the occurrence of such uneven discharge because the timing of appearance of such uneven discharge is difficult to predict as explained above and also because the inspection of the apparatus by the servicing personnel cannot be very frequent. Therefore, such method results in an increased number of maintenances and a wasted consumption of discharge wires.

SUMMARY OF THE INVENTION

In consideration of the foregoing, the object of the present invention is to provide an image forming apparatus capable of resolving the drawbacks in the prior art.

An aspect of the present invention is to enable to measure the imaging characteristic over the entire area of the photosensitive member, by moving the means for measuring potential or reflective density in the axial direction of the photosensitive member, thereby optimizing the image forming condition in each step.

Another aspect of the present invention is to generate an alarm in case a controlled amount exceeds the amount of control by the control means or generates a large ripple, and to automatically display the item of maintenance through the combination of the measuring means mentioned above, thereby improving the servicing capability.

More specifically, according to an aspect of the present invention, there is provided an image forming apparatus comprising potential measuring means movable in hte axial direction perpendicular to the rotating direction of the photosensitive member; density measuring means for measuring image density, capable of moving in said axial direction; ability detection means for detecting the image forming ability in each of the latent image formation step and image development step utilizing both of said measuring means; control means for controlling the image forming conditions in each of said steps; and abnormality detection means for detecting abnormality in each of said steps.

In such configuration, the ability detection means detects the image forming ability in each of the latent image formation step and the image development step, while the control means controls the image forming conditions of said steps, and the abnormality detection means detects the abnormality in said steps.

According to another aspect of the present invention, there is provided an image forming apparatus provided with a pre-exposure device, a charging device, an exposure device and a development device around a rotating photosensitive member, wherein a latent image is formed on the surface of said photosensitive member by exposure, after charging thereof, with said exposure device, and is then developed with developer supplied from said development device, comprising a potential measuring device provided movably in a direction crossing the moving direction of said photosensitive member and adapted to measure the surface potential thereof; a reflective density measuring device provided movably along said crossing direction, in synchronization with said potential measuring device and adapted to measure the reflective surface density of said photosensitive member; and a control device for regulating at least one of the charging potential of said charging device, the developing condition of said development device, the transfer condition of an image transfer device, and the exposure amount of said pre-exposure device, based on signals from said potential measuring device and said reflective density measuring device.

Also said pre-exposure device may be provided with a plurality of light-emitting elements arranged along a direction crossing the moving direction of said photosensitive member, and the amount of light from each of said light-emitting elements may be regulated according to the signal from said potential measuring device or said reflective density measuring device.

In the above-mentioned configuration, since the potential measuring device and the reflective density measuring device are respectively movable in the axial direction of the photosensitive member, said movement and the rotary movement of the photosensitive member may be combined to two-dimensionally scan the surface of the photosensitive member with the potential measuring device or the reflective density measuring device, thereby detailedly detecting the fine variations in the potential or reflective density. Thus a uniform image can be obtained by actuating the control device according to the signals from the potential measuring device and the reflective density measuring device, thereby optimizing the potential of the charging device, the developing condition of the development device, the image transfer condition of the transfer device and the exposure amount of the pre-exposure device. Besides, since the potential measuring device and the reflective density measuring device are mutually synchronized and can measure a same point on the photosensitive member, it is easily possible to identify whether an unevenness in the image results from a defective surface potential of the photosensitive member or from a defect in the development device.

If the pre-exposure device is provided with a plurality of light-emitting elements arranged along the axial direction of the photosensitive member, an appropriate charged surface potential can be obtained on the photosensitive member, by regulating the amounts of light from the light-emitting elements according to the signal from said potential measuring device or said reflective density measuring device.

According to another aspect of the present invention, there is provided an image forming apparatus provided with a rotatably supported image bearing member, and electrostatic latent image forming means and development means positioned around said image bearing member, comprising a potential measuring device positioned between said latent image forming means and said development means and adapted to measure the surface potential of the external periphery of said image bearing member; a reflective density measuring device positioned at the downstream side of said development means in the rotating direction of said image bearing member and adapted to measure the reflective density of a visible image formed by said development means; measurement position varying means for rendering said potential measuring device and said reflective density measuring device movable in synchronization along the direction of rotary axis of said image bearing member; test pattern means for sending a predetermined signal to said latent image forming means in order to form an electrostatic latent image constituting a test pattern on said image bearing member; and control means for calculating the characteristics of said image bearing member, said latent image forming means or said development means, based on the surface potential of said test pattern measured by said potential measuring device or the reflective density of a visible image formed from said test pattern, measured by said reflective density measuring device, and controlling said latent iamge forming means according to the result of said calculation.

In the above-explained configuration, said test pattern means sends a predetermined signal to said latent image forming means, thereby forming an electrostatic latent image, constituting a test pattern, on the image bearing member. Said test pattern moves, by the rotation of the image bearing member, to a position opposed to the development means, and is developed as a visible image.

On the other hand, the surface potential of said electrostatic latent image, constituting the test pattern, is measured by said potential measuring device, and the reflective density of the visually developed test pattern is measured by the density measuring device.

The control means calculates the characteristics of said image bearing member, said latent image forming means or said development means based on the signal obtained by the measurement of said test pattern with said potential measuring device or said density measuring device, and controls the latent image forming means according to the result of said measurement.

According to still another aspect of the present invention, there is provided an image forming apparatus equipped with a rotatably supported image bearing member, and electrostatic latent image forming means and development means positioned around said image bearing member, comprising a potential measuring device positioned between said latent image forming means and development means and adapted to measure the surface potential of the external periphery of said image bearing member; a reflective density measuring device positioned at the downstream side of said development means in the rotating direction of said image bearing member and adapted to measure the reflective density of a visible image formed by said development means; measurement position varying means for rendering said potential measuring device and said density measuring device movable in synchronization along the direction of rotary axis of said image bearing member; test pattern means for sending a predetermined signal to said latent image forming means in order to form an electrostatic latent image, constituting a test pattern on said image bearing member; development position selecting means for selecting, as a development area, only a portion in the axial direction on the image bearing member, corresponding to the position of said potential measuring device and density measuring device; and control means for calculating the characteristics of said latent image forming means or development means, based on the surface potential of said test pattern measured by said potential measuring device or the reflective density of a visible image obtained from said test pattern, measured by said density measuring device, and controlling said latent image forming means according to the result of said calculation.

In this configuration, said control means may be so constructed as to control said latent image forming means by converting density data based on the original image density.

In the above-mentioned configuration, said test pattern means sends the predetermined signal, and the development position selecting means effects image development only in a portion of the image bearing member, corresponding, in the axial position, to said potential measuring device and said density measuring device. Consequently the electrostatic latent image, of the test pattern, positioned on the image bearing member, corresponding to the position of said potential measuring device and density measuring device, is developed but other areas are not developed.

On the other hand, the surface potential of said test pattern is measured by the potential measuring device, while the reflective density of the visibly developed test pattern is measured by the density measuring device.

Also the control means calculates the characteristics of said image bearing member, latent image forming means and development means, based on the signals obtained by the measurement of said test pattern by said potential measuring device and said density measuring device, and controls the latent image forming means according to the result of said calculation.

According to still another aspect of the present invention, there is provided an image forming apparatus equipped with a photosensitive member, discharge means for charging said photosensitive member, exposure means for irradiating said photosensitive member, after charging, with an optical image thereby forming a latent image thereon, and development means for rendering said latent image visible, comprising potential detection means for detecting the potential distribution on the photosensitive member after said charging or density detection means for detecting the density distribution of said visible image, and discrimination means for discriminating the necessity for maintenance of said discharge means, based on the result of detection by said potential or density detection means.

Also there is provided alarm means for displaying the necessity for maintenance, in case said discrimination means identifies the necessity for maintenance.

Furthermore, a discharge member constituting said discharge means is a fine wire of a conductive material extended in a discharge area close to said photosensitive member, and said discharge means includes a feed pulley for storing an unused portion of said fine wire, a take-up pulley for winding a used portion of said fine wire, and driving means for driving said pulleys so as to take up a used portion of said fine wire in said discharge area onto the take-up pulley and to feed an unused portion from the feed pulley to said discharge area, when said discrimination means identifies the necessity for maintenance.

In the above-explained configuration, the photosensitive member after charging is irradiated with the optical image to form a latent image, which is developed by the development means into a visible image.

On the other hand, the potential distribution on the photosensitive member, or the density distribution of the visible image, is detected respectively by the potential detection means or the density detection means, and the discrimination means identifies the necessity for the maintenance of the discharge means, based on the result of said detection.

If the maintenance is identified necessary, the alarm means provides a display that the maintenance is to be carried out.

The charging of the photosensitive member is executed by discharge from the fine wire of conductive material. When the discrimination means identifies the necessity for maintenance, the drive means automatically activates the feed and take-up pulleys, thereby taking up the smeared wire in the discharge area onto the take-up pulley and feeding an unused portion of the fine wire to the discharge area from the feed pulley.

In still another aspect of the present invention, there is provided an image forming apparatus capable of locally controlling the process amount of image forming process means, based on the detection of distribution of image forming ability.

In still another aspect of the present invention, there is provided an image forming apparatus capable, based on the detection of distribution of image forming ability, of correcting the image signal according to said distribution.

Still other objects of the present invention, and the advantages thereof, will become fully apparent from the following detailed description to be taken in conjunction with the accompanying drawings.

BRIEF DESCRIPTION OF THE DRAWINGS

FIG. 5 is a chart of a diagnostic system of a 2nd embodiment;

DESCRIPTION OF THE PREFERRED EMBODIMENTS

[1st embodiment]

Figure 1:
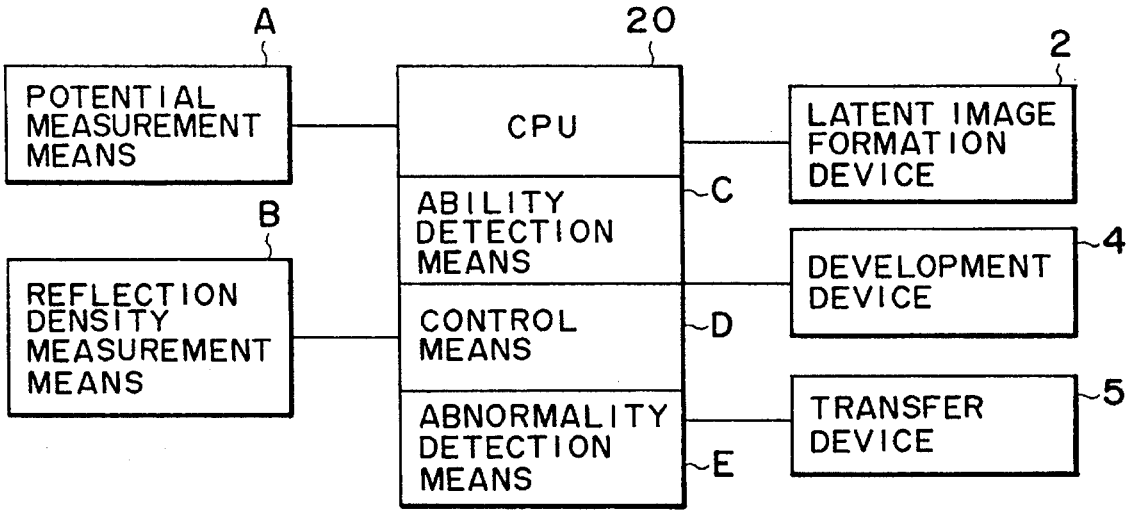
FIG. 1 is a block diagram of a 1st embodiment of the present invention.
Figure 2:
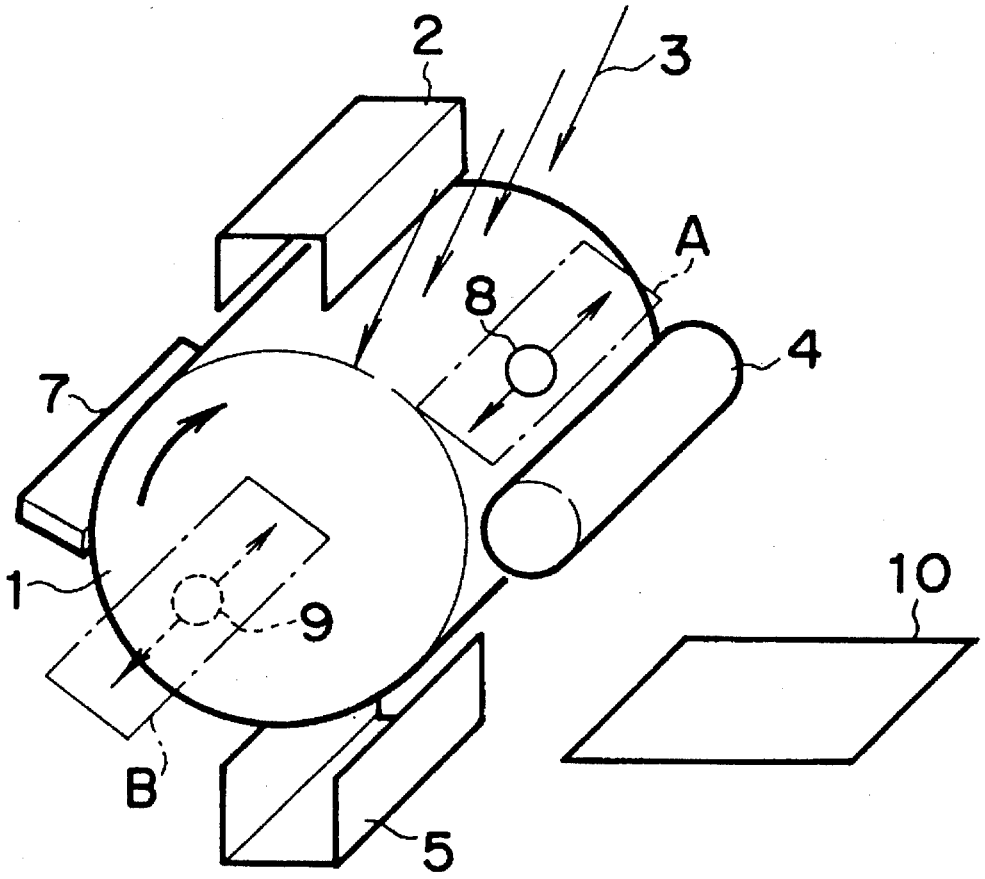
FIG. 2 is a perspective view of an image forming apparatus constituting the 1st embodiment.

Referring to FIG. 1, potential measuring means A is composed of a potential measuring device 8 shown in FIG. 2 and capable of moving in the axial direction perpendicular to the rotating direction of a photosensitive member 1. Reflective density measuring means B is composed of a reflective density measuring device 9, capable of moving in said axial direction, in synchronization with the potential measuring means A.

Ability detection means C is composed of a CPU 20 and serves to detect the image forming ability in each of the steps of latent image formation, development and transfer. Control means D, also composed of the CPU 20, serves to control the image forming conditions in each of said steps. Abnormality detection means E, also composed of the CPU 20, serves to detect abnormality in each of said steps. The details of the above-mentioned means will be explained later.

In FIG. 2 there are shown a photosensitive member 1; a latent image forming (charging) device 2; an imagewise exposing light 3 from an unrepresented exposure means; a development device 4 for developing the latent image; a transfer device 5 for transferring the image onto a transfer sheet 10; and a cleaning device 7 for cleaning the surface of the photosensitive member.

The function of this embodiment will be explained in the following with reference to FIG. 2.

The potential measuring device 8 moves along a direction indicated by arrows (hereinafter called axial direction), perpendicular to the rotating direction of the photosensitive member, thereby measuring the latent image potential on the photosensitive member in said axial direction.

By providing a predetermined charging current from the charging device 2 and varying the imagewise exposure into the levels for example of no exposure (dark area), intermediate exposure (intermediate density area) and maximum exposure (light area), the latent image potential accordingly varies in the levels of high, intermediate and low. By measuring these potential in the axial direction, there can be identified whether the average of plural measurements and the difference (ripple) between the maximum and minimum potentials are at the desired values. The reflective density measuring device 9 similarly moves in the axial direction, thereby measuring the toner density distribution on the photosensitive member.

Figure 3:
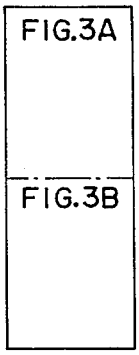
FIGS. 3, 3A, 3B, and 4 are flow charts of the control sequence of the 1st embodiment.
Figure 3A:
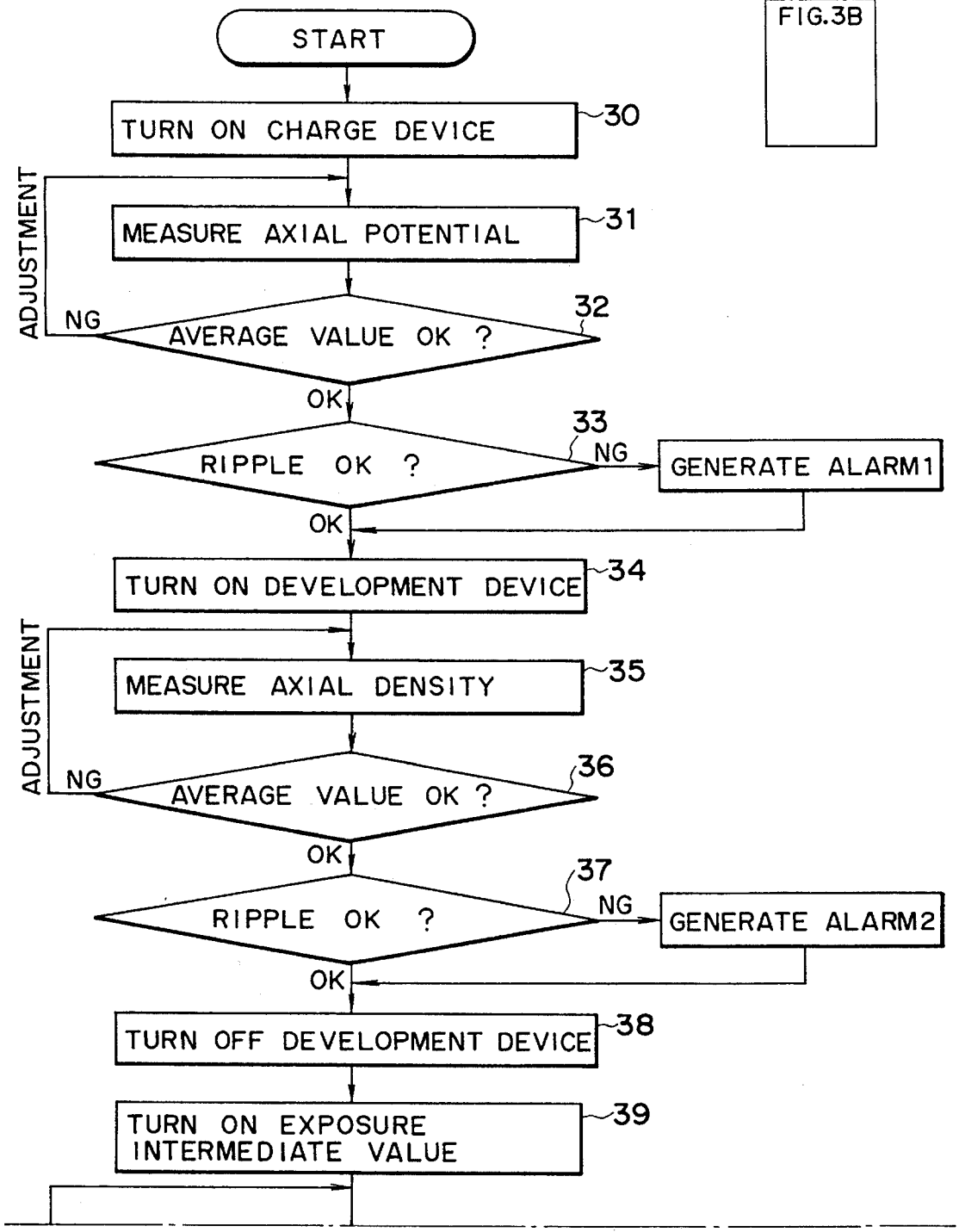
Figure 3B:
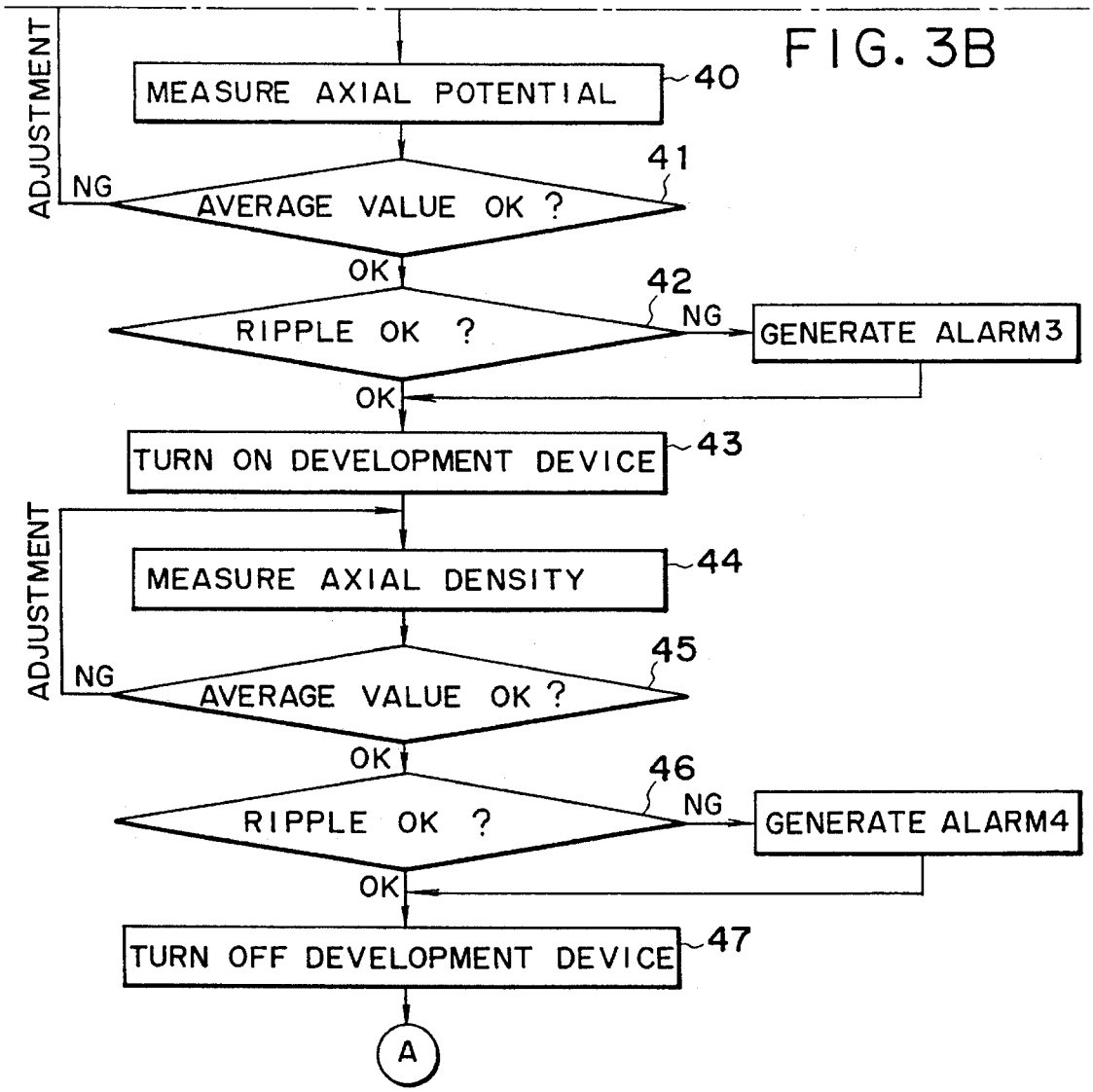
Figure 4:
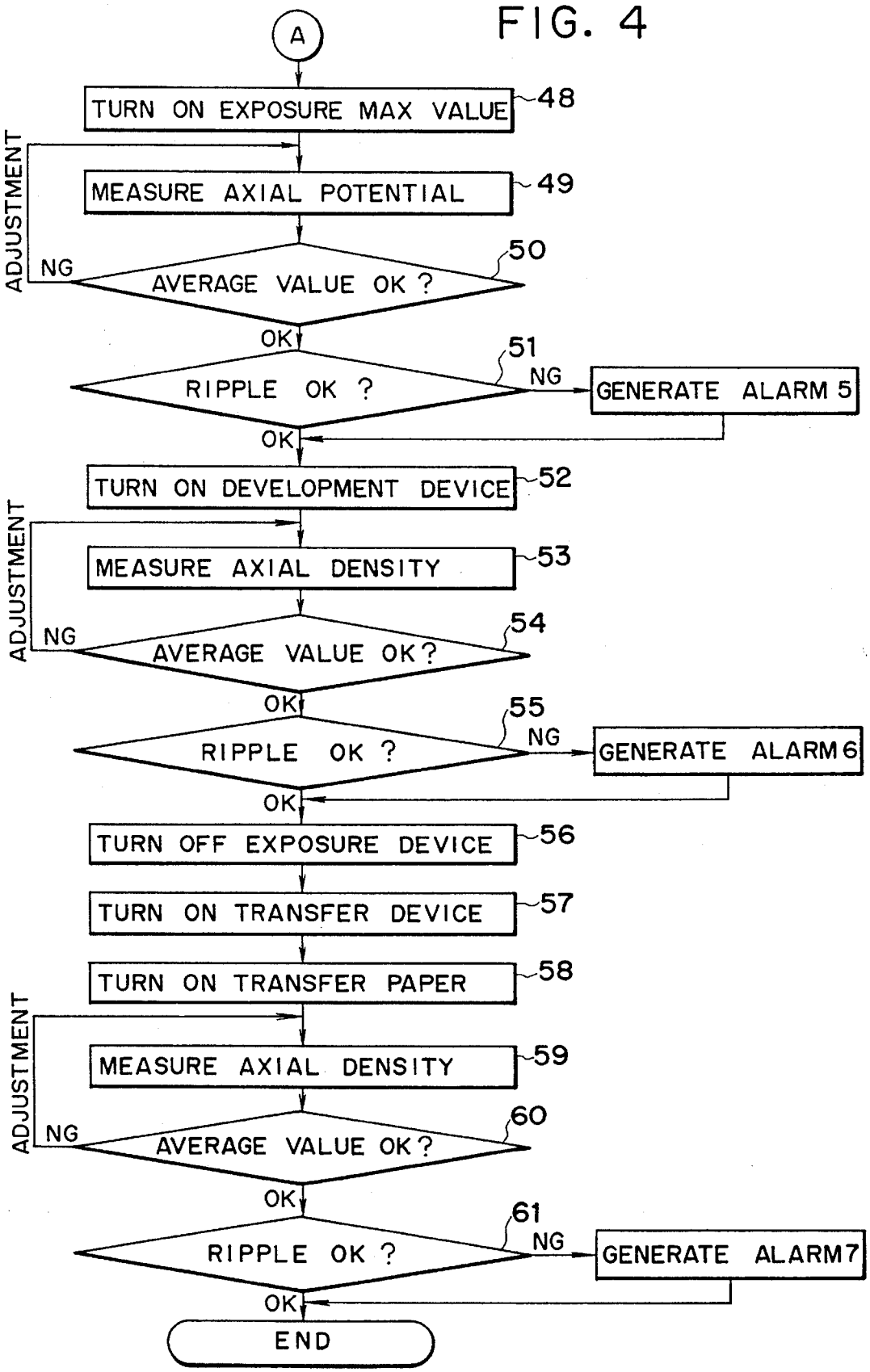

In the following there will be explained the control sequence of this embodiment, principally the detection system thereof, with reference to FIGS. 3 and 4.

At first the charging device 2 is turned on (step 30), and the latent image potential in the dark area of the photosensitive drum, not exposed to the light, is measured (step 31). If the average of plural detections along the axial direction is not at a desired value or within a desired range (NG in step 32), the output of the charging device 2 is suitably regulated. After said regulation, if the difference between the maximum or minimum potential and the average (potential ripple) is larger than a desired value (NG in step 33), an alarm 1 is given.

If the ripple is smaller than the predetermined value, the development device is turned on (step 34) to form a visible toner image on the photosensitive member 1, and the reflective density of said image is measured with the density measuring device 9 (step 35).

If the average reflective density of plural detections in the axial direction is not at a desired value or within a desired range (NG in step 36), regulation is conducted for example on the bias of the development device, revolution of a developing sleeve or toner amount in the development device. After said regulation, if the difference (ripple) between the maximum or minimum value and the average of the plural detections in the axial direction is larger than a desired value (NG in step 37), an alarm 2 is given.

Thereafter conducted similarly are the potential adjustment ripple alarm 3 generation for intermediate exposure (steps 38–42), density adjustment and ripple alarm 4 generation for intermediate exposure (steps 43–46), potential adjustment and ripple alarm 5 generation for maximum exposure (steps 47–51) and density adjustment and ripple alarm 6 generation for maximum exposure (steps 52–55).

Then the exposure is turned off (step 56) while the charging and development devices 2, 4 are turned on and the toner image is transferred onto the transfer sheet by the transfer device 10 (steps 57–58). In this state the remaining toner density is measured in the axial direction (step 59), then the adjustment is conducted according to the average of the measured values (NG in step 60), and discrimination is made whether the ripple of said measured values (step 61) to generate an alarm 7.

The above-explained control operations are preferably conducted while the apparatus is not in the image forming operation, for example during the warmup period of the fixing device after the power supply is turned on, or during the maintenance work.

The terms employed in the foregoing description have the following meanings.

The "average" for example of potential is the average value Vm of potentials measured at 50 predetermined positions along the axial direction, and "ripple" means the deviation from said "average". For example, said "ripple" can be represented by $|Vm-Vmin|$ or $|Vm-Vmax|$. It may also be represented by $|Vmin-Vmax|$. Vmin and Vmax indicate respectively the minimum and maximum values in said 50 measuring positions. The measurement of reflective density is similarly conducted at predetermined 50 positions.

The 50 measuring positions for potential and those for density are so selected that they have mutually same positional relationship in the axial direction. Consequently the measuring devices measure mutually same positions in the axial direction. The "average" in density is represented by Dm, and the "ripple" is represented by $|Dm-Dmin|$ or $|Dm-Dmax|$ wherein Dmin and Dmax are respectively minimum and maximum values in the 50 measuring positions. Each of the alarms 1–7 is generated also when the average cannot be controlled to the desired value.

In the following there will be explained, with reference to FIG. 5, a diagnostic system utilizing the above-explained detection system of the present embodiment.

According to FIG. 5, the items of maintenance are automatically selected, empirically, from the combinations of on-off states of the alarms. As an example, when all the alarms 1–7 are on, the item of maintenance is the charging device, because the abnormality in the charging device is considered to affect all the images. Also the exposure and other devices require inspection, as the possible abnormality in other devices cannot be confirmed. Thus the charging device requires certain maintenance, while other devices require inspection.

Also in case the alarms 2–7 are on, it is estimated that the charging is conducted satisfactorily but the development is abnormal. In case the alarms 3–6 are on, the exosure is estimated abnormal.

The steps of latent image formation, development and transfer can thus be optimized by the adjustments explained above, and, in case of a ripple, an alarm is generated as the information for the maintenance work.

For adjusting the development device or detecting the abnormality therein, it is possible to develop the photosensitive member without charging thereon, with a developing bias of a predetermined value of opposite polarity. The abnormality can be detected solely in the development device, by measuring the reflective density of thus obtained visible image in the axial direction.

Also the adjustment and abnormality detection of the transfer device alone can be achieved by measuring the potential in the axial direction after transfer charging while other devices are turned off.

As explained in the foregoing, the 1st embodiment of the present invention enables to comprehend the imaging characteristic over the entire area of the photosensitive member and to optimize the image forming condition in each of the image forming steps, by moving the potential measuring means and the reflective density measuring means in the axial direction of the photosensitive member.

Also in case the control amount is exceeded or the ripple becomes large, tehre are generated alarms for the abnormalities, and the items requring maintenance can be automatically indicated by the combination of said alarms, so that the servicing ability can be improved.

In contrast to the foregoing 1st embodiment designed to provide alarms, the following embodiment is to obtain uniform distribution in response to the obtained distribution in potential or density.

[2nd embodiment]

A 2nd embodiment of the image forming apparatus of the present invention will be explained in the following, with reference to FIGS. 6 to 11.

Figure 6:
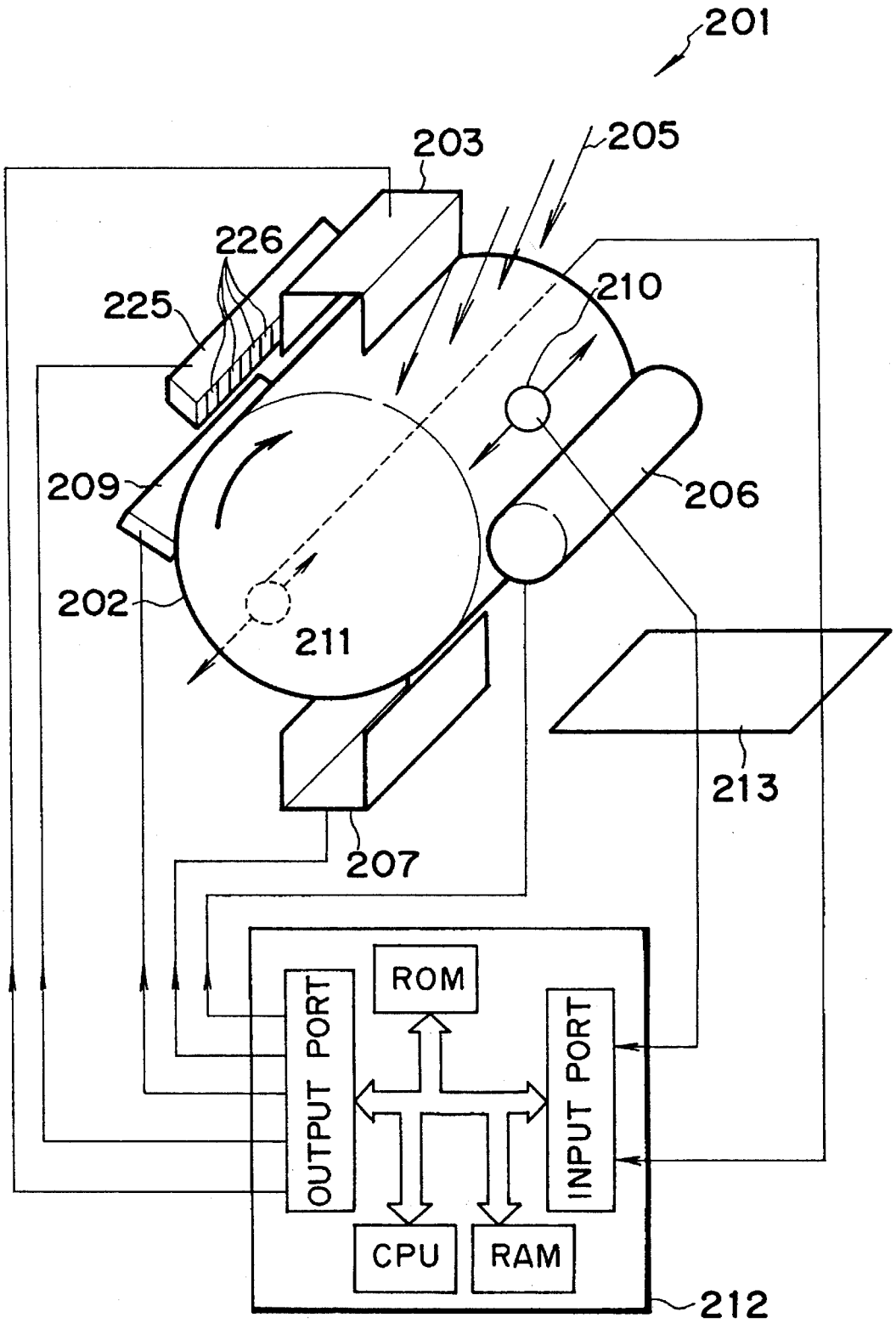
FIG. 6 is a schematic view of an image forming apparatus constituting a 2nd embodiment of the present invention.

As shown in FIG. 6, the image forming apparatus 201 of the present embodiment is provided with a cylindrical photosensitive member 202; a charging device 203, an exposure device 205, a development device 206, a transfer device 207, a cleaning device 209, and a pre-exposure device 225 positioned along the external periphery of said photosensitive member 202; a potential measuring device 210 positioned between the charging device 203 and the development device 206 and adapted to measure the potential of the photosensitive member 202; a reflective density measuring device 211 positioned between the transfer device 207 and the cleaning device 209 and adapted to measure the density of developer (toner) on the photosensitive member 202; and a control device 212 for controlling the above-mentioned devices.

Said photosensitive member 202 is provided, on the surface thereof, with a photosensitive layer showing photoconductivity, and is rotated in a direction indicated by an arrow by unrepresented driving means, thereby effecting so-called main scanning. Said charging device 203 is provided with an electrode, for charging the photosensitive layer provided on the surface of the photosensitive member 202 to a predetermined potential. The exposure device 205 irradiates the photosensitive layer, charged to the predetermined potential by the cahrging device 203, with imagewise light, conducted through an unrepresented optical system, thereby forming an electrostatic latent image on the photosensitive member 202.

The development device 206 deposits developer (toner), which is charged in advance to a polarity opposite to that of the charge constituting the electrostatic latent image on the photosensitive member 202, on said electrostatic latent image for example by a developing roller, thereby rendering said latent image visible. The transfer device 207 transfer the visible image (toner image), formed on the photosensitive member 202, onto a sheet material 213 such as paper, by applying an inverse potential from the rear side of said sheet material. The sheet material 213, bearing the transferred toner image, is transported thereafter to a fixing device consisting of unrepresented heating means and is heated therein, whereby the toner image is fixed by fusion to the sheet material 213.

The cleaning device 209 removes the unnecessary toner remaining on the photosensitive member 202 after the image transfer onto the sheet material 213.

The pre-exposure device 225 is composed, for example, of fifty LED's (light emitting diodes) 226 arranged at a constant pitch across the width of the photosensitive member 202, and is used for regulating the surface potential of the photosensitive member 202, by irradiating the surface thereof with light.

Figure 7:
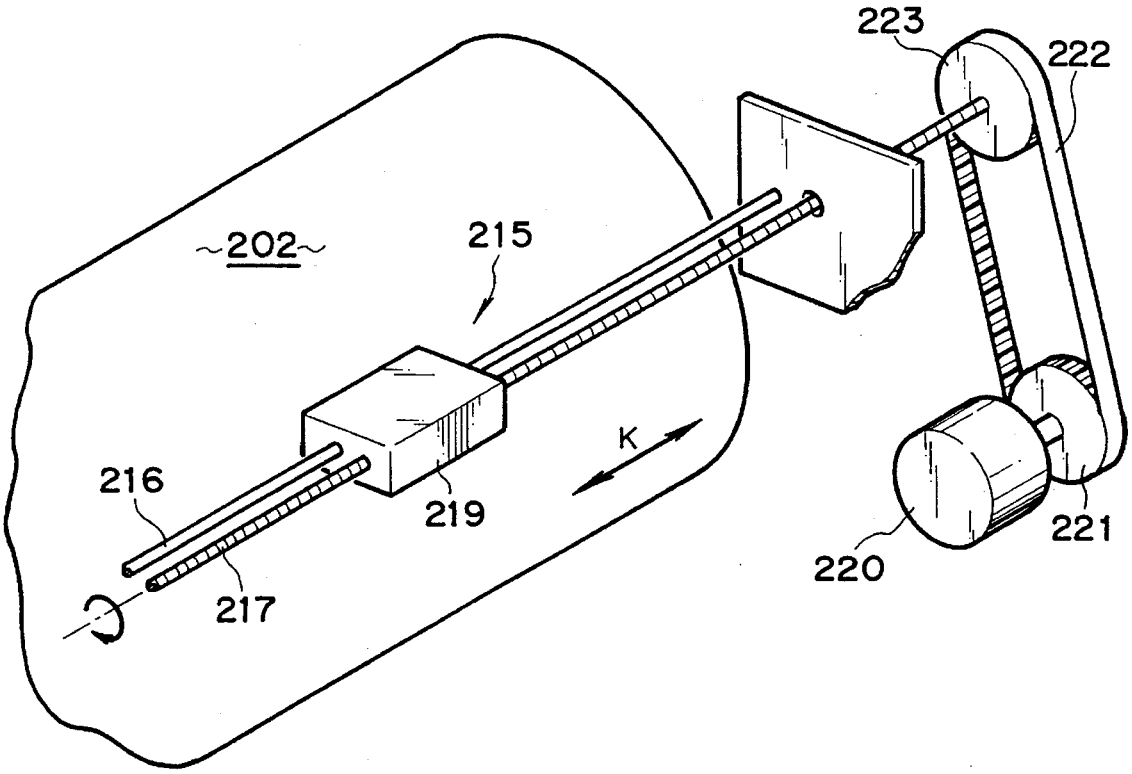
FIG. 7 is a perspective view of sliding means for the potential measuring device.

The potential measuring device 210 is provided, as shown in FIG. 7, movably along the axial direction K of the photosensitive member 202 by means of slide means 215. Said slide means 215 is composed of a slide guide 216 provided parallel to the axial direction of the photosensitive member 202; a screw 217; a screw nut 219 which engages with said screw 17, is slidably supported by the slide guide 216 and is fixed to the potential measuring device 210; and a pulley 223 fixed to an end of the screw 217 and supporting a driving belt 222 in cooperation with another pulley 221 fixed on the driving shaft of a motor 220. Said potential measuring device 210 measures the surface charged potential (potential of electrostatic latent image) of the photosensitive member 202, for supply to the control device 212.

Similarly the reflective density measuring device 211 is provided movably in the axial direction of the photosensitive member 202 by a device equivalent to said slide means 215, and serves to measure the reflective density of the surface of the photosensitive member 202, after the transfer of toner image onto the sheet material 213 by the transfer device 207.

Figure 8:
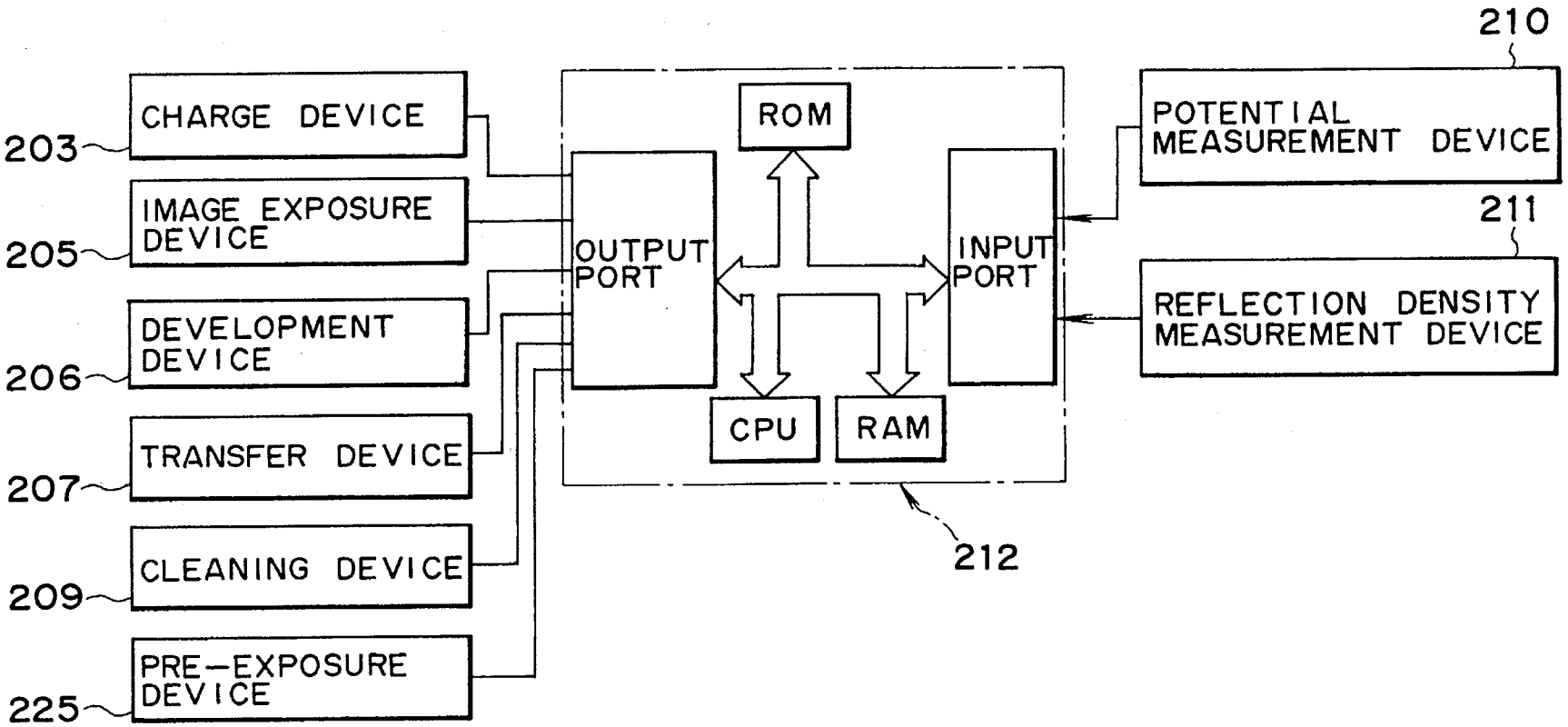
FIG. 8 is a block diagram of a control device.

As shown in FIG. 8, the control device 212 is connected to the charging device 203, exposure device 205, development device 206, transfer device 207, cleaning device 209, pre-exposure device 225, potential measuring device 210 and density measuring device 211, and optimizes the charging potential of the charging device 203, exposure condition of the exposure device 205, developing condition of the development device 206, transfer condition of the transfer device 207 and exposure condition of the pre-exposure device 225, based on the signals from the potential measuring device 210 and the reflective density measuring device 211.

Figure 9:
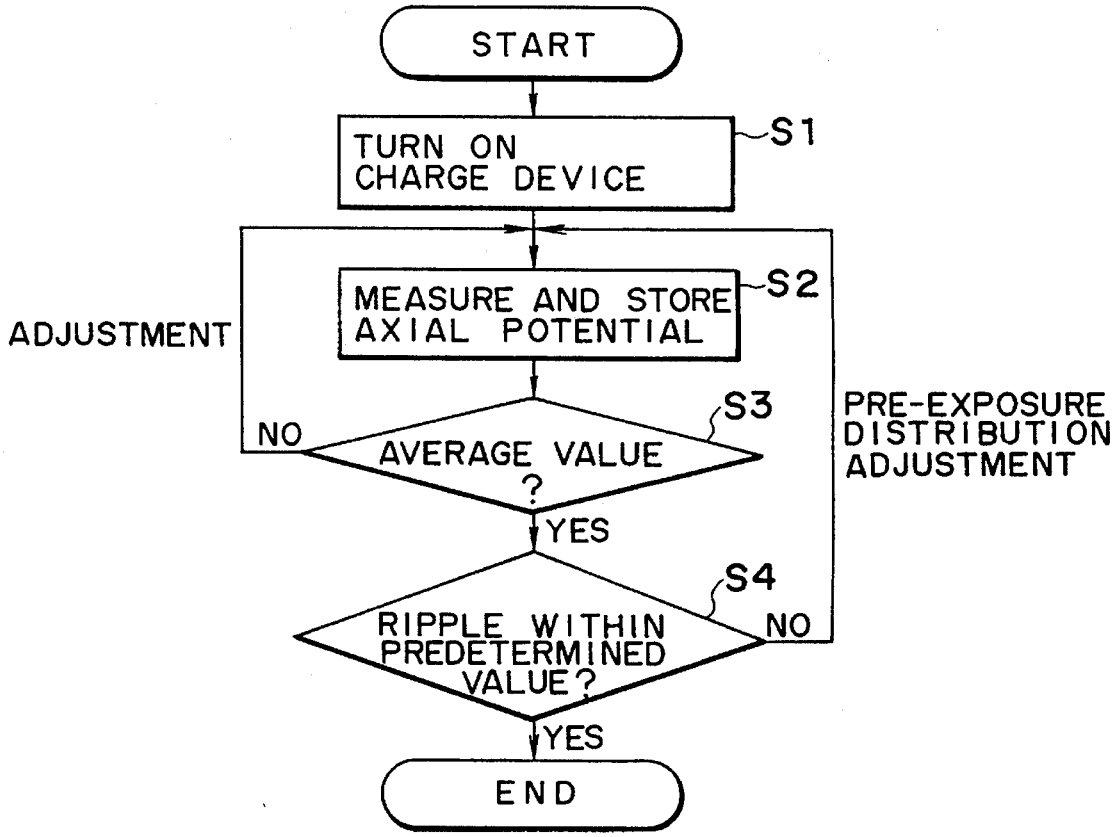
FIG. 9 is a flow chart of the control sequence of the 2nd embodiment.
Figure 10:
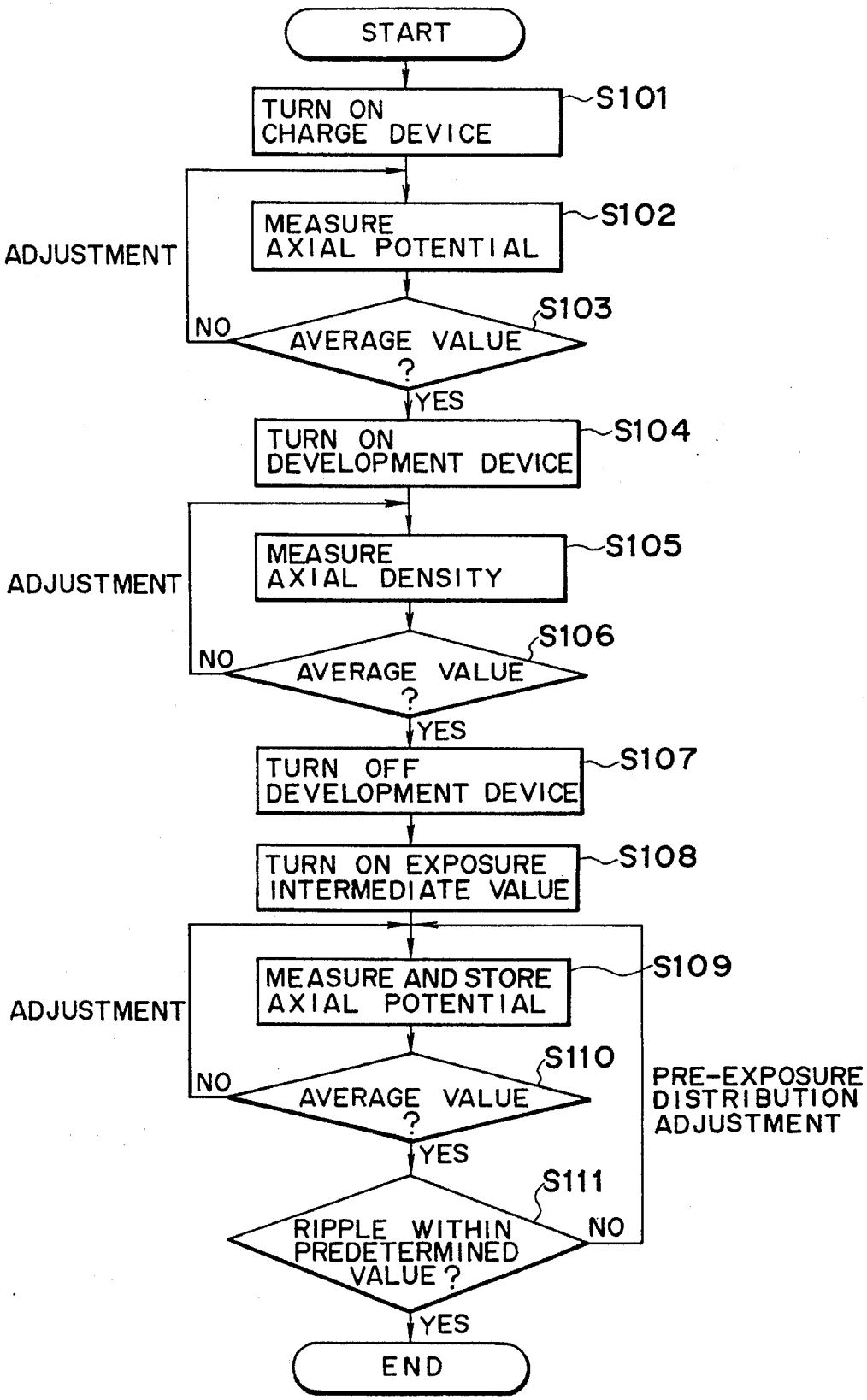
FIG. 10 is a flow chart showing the method for regulating the pre-exposure distribution for the image halftone level.
Figure 11:
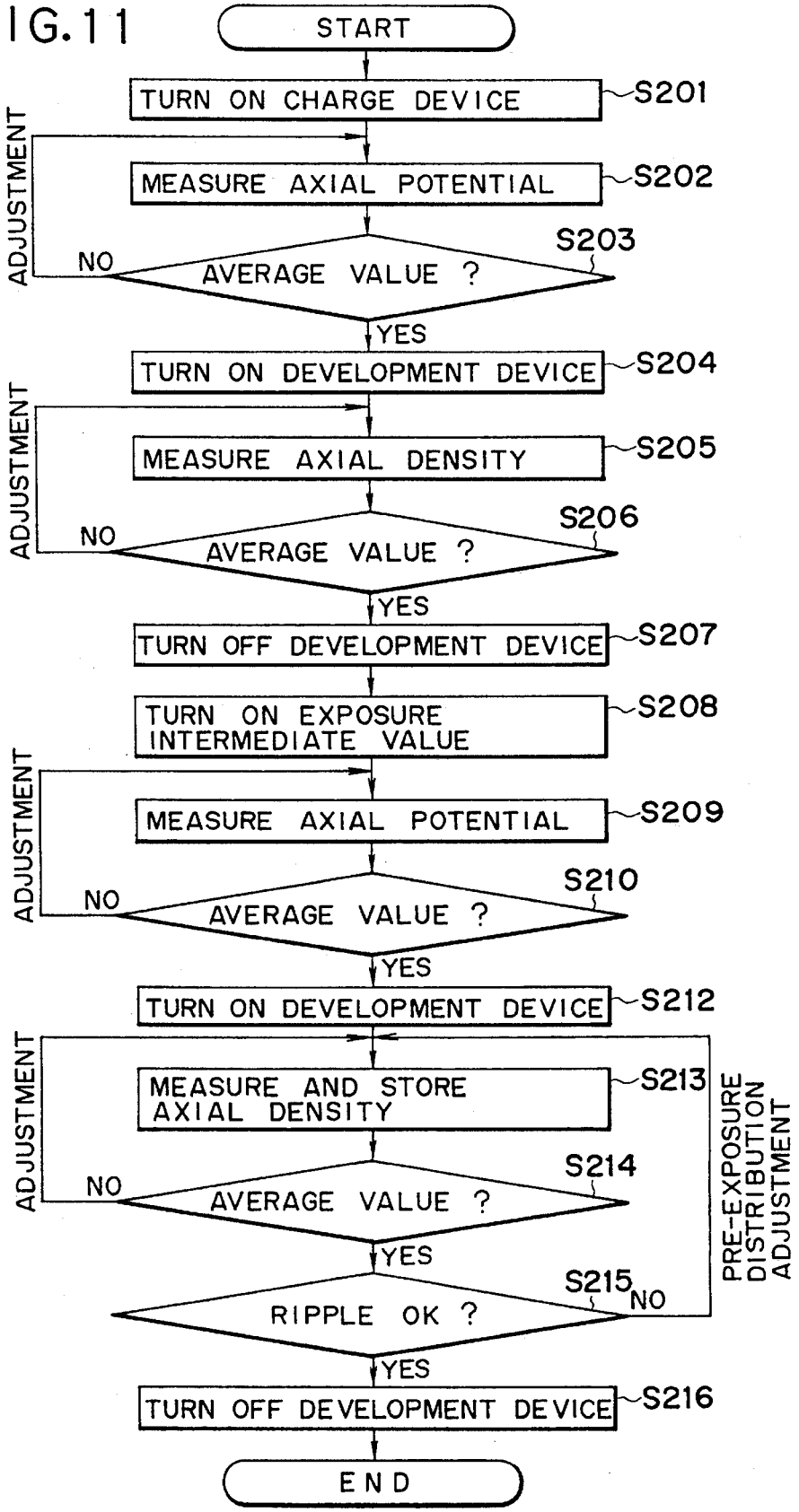
FIG. 11 is a flow chart showing the method for correcting ripples based on a toner image formed on the photosensitive member.

In the following there will be explained the function of the control device 212 with reference to FIGS. 9, 10 and 11.

For forming an electrostatic latent image, a predetermined charging current is released from the charging device 203 (S1), and the amount of exposure is varied for example zero (dark area), intermediate (intermediate density area) and maximum (light area), whereby the latent image potential respectively varies as high, intermediate and low. Each of thus varied potentials is measured by the potential measuring device along the axial direction of the photosensitive member 202 (S2), whereby it is rendered possible to identify whether the average and the ripple of the potential are at the desired levels (S3).

If the average of the potentials of the photosensitive member 202 under zero exposure is not at the desired value, the potential of the photosensitive member 202 is regulated by controlling the output of the charging device 203. If the potential ripple in the axial direction of the photosensitive member 202 is larger than the desired value, said potential ripple can be corrected for example by regulating fifty LED's 226 of an LED array constituting the pre-exposure device 225, corresponding to the potentials measured in 50 positions across the width of the photosensitive member 202 (S4).

The surface potential of the photosensitive member 20 becomes lower or higher, respectively when the light amount from the LED 226 increases or decreases. By predetermining this relationship, the amount of light from the LED 226 can be controlled according to the measured deviation of the potential from the average value.

More specifically, when the photosensitive member 202 has surface potentials V1, V2, . . . , Vn, . . . , V50 across the width thereof with an average value Va, the amount of light may be varied according to V1–Va, V2–Va, . . . , Vn–Va, . . . , V50–Va. If the average light amount e of the LED provides a potential Va= Ae+B wherein A and B are constants, the potential V1 for the LED1 can be shifted to Va by a light amount corresponding to V1–Va, namely by (V1–Va)/A. Similarly the potential Vn for the LEDn can be shfited to Va by increasing the light amount by (Vn–Va)/A.

The above-explained operations are preferably conducted while the apparatus is not in the image forming operation, for example during the warming up of the fixing devcie or during the maintenance work.

The above-mentioned "average" is obtained, for example in case of potential, by measuring the potential in predetermined 50 positions in the axial direction of the photosensitive member 202, storing thus obtained values in a RAM and calculating the average of said values. Also the "ripple" means the deviation from the "average", represented for example by |Va–Vmin| or |Va–Vmax|, wherein Vmin and Vmax are respectively the minimum and maximum values in 50 measured values.

In the following there will be explained the method of adjusting the distribution of pre-exposure amount at the halftone level of image, with reference to FIG. 10.

After the adjustment of the outputs of the charging device 203 and the development device 206 (S101 to S107), irradiation is made with an intermediate amount of exposure (S108), and the amount of pre-exposure is corrected by measuring the potential of halftone level with the potential measuring device 210. The correcting method is same as that shown in FIG. 6 (S109 to S111 in FIG. 10).

Since the image is most affected by the halftone, the adjustment at the halftone level is most effective for the actual image. In these adjustments, the aforementioned constants A, B have to be converted to those for the halftone level.

In the following there will be explained, with reference to FIG. 11, a method for correcting ripples by a toner image formed on the photosensitive member 202.

The density measurement is conducted on predetermined fifty positions. The 50 positions for potential measurement and those for density measurement are preferably arranged same in the axial direction of the photosensitive member 202.

The "average" in density is represented by Da, and the ripple is represented by |Da–Dmin| or |Da–Dmax| wherein Dmin and Dmax are respectively the minimum and maximum values in the 50 measured values.

This method is effective, after the adjustments of the latent image forming device and the development device 206 (S201 to S210 in FIG. 11), for correcting the resulting ripple (S212 to S216 in FIG. 11) and is most effective for the actual image.

The correlation between the variation in the light amount of the LED 226 and the variation in the toner density in the halftone area is entered in advance, and the ripple in the halftone area can be corrected by the individual correction of the LED array for the preexposure.

As explained in the foregoing, the image forming apparatus of the present embodiment can not only comprehend the imaging characteristics of the photosensitive member over the entire area thereof and optimize the image forming condition in each of the image forming steps, but also correct the amount of pre-exposure in necessary positions thereby providing a uniform image without unevenness.

[3rd embodiment]

In the following there will be explained a 3rd embodiment of the present invention, with reference to the attached drawings.

Figure 12:
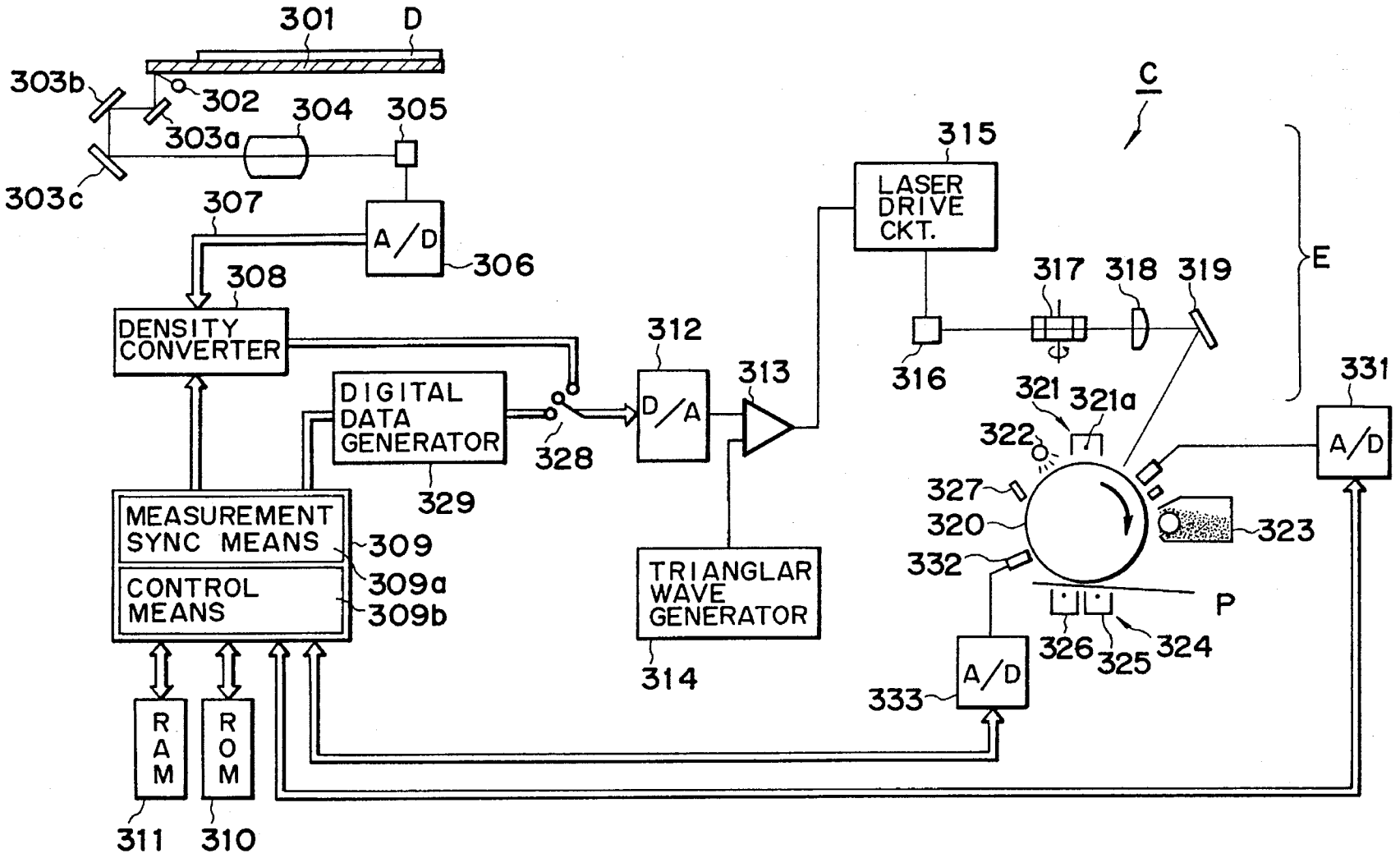
FIG. 12 is a block diagram of an image forming apparatus constituting a 3rd embodiment.

FIG. 12 is a block diagram of an electrophotographic digital copying machine (in which image being recorded after converted into digital electrical signals) as an image forming apparatus of the present invention.

Figure 13:
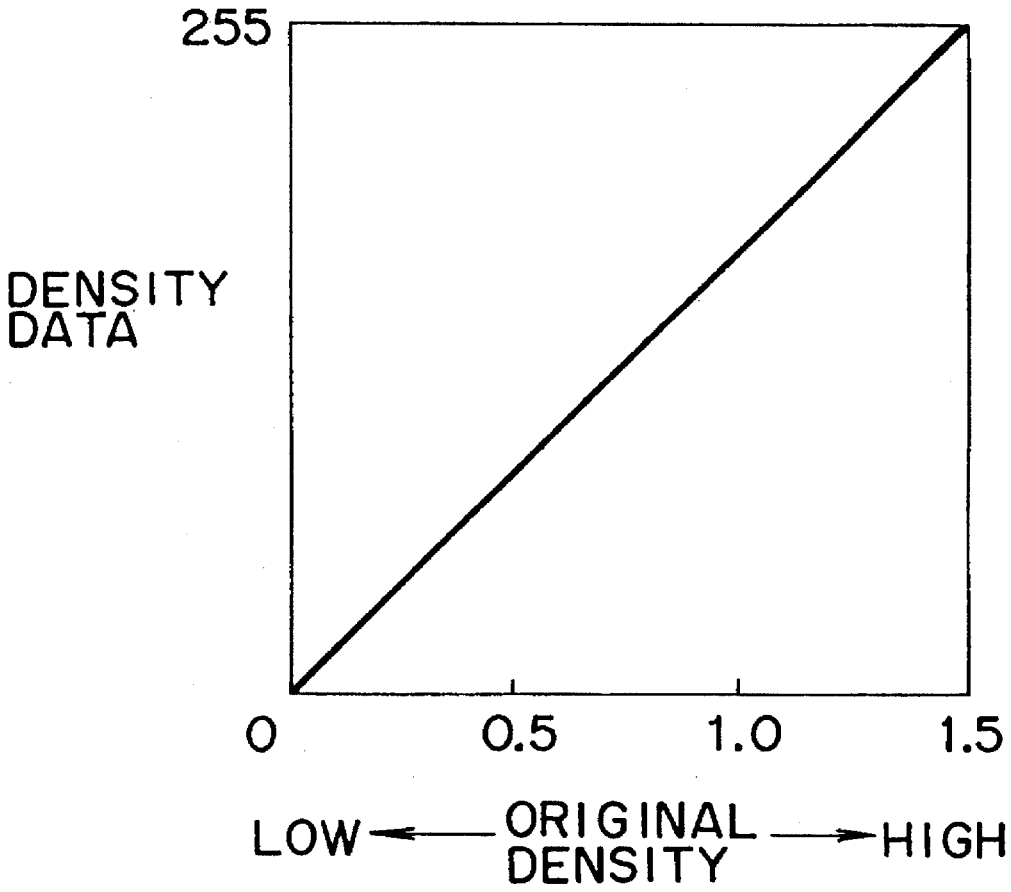
FIG. 13 is a chart showing the relation between the original image density and the input density data.

In the following there will be briefly explained the structure of the copying machine C. A platen glass 301, for supporting an original document D, is mounted on the upper face of the copying machine C, and an illuminating lamp 302 is provided below said platen glass 301. Said illuminating lamp 302 is composed of a straight halogen lamp and is so constructed as to move along the platen glass 301, by means of unrepresented driving means. Mirrors 303*a*, 303*b*, 303*c* are so positioned as to guide the light, reflected from the original document, through a lens 304 toward a photoelectric converter element 305, which converts said reflected light into an electrical signal corresponding to the amount of said light. An A/D converter 306 converts said electrical signal into an 8-bit digital signal, which is subjected the steps of light amount-density conversion, black level correction and shading correction (all not shown) to provide density data 307. Said density data 307 are an 8-bit (level 0–255) digital signal, including the density information of the original document, and in a linear relationship with the original density (cf. FIG. 13).

Figure 14:
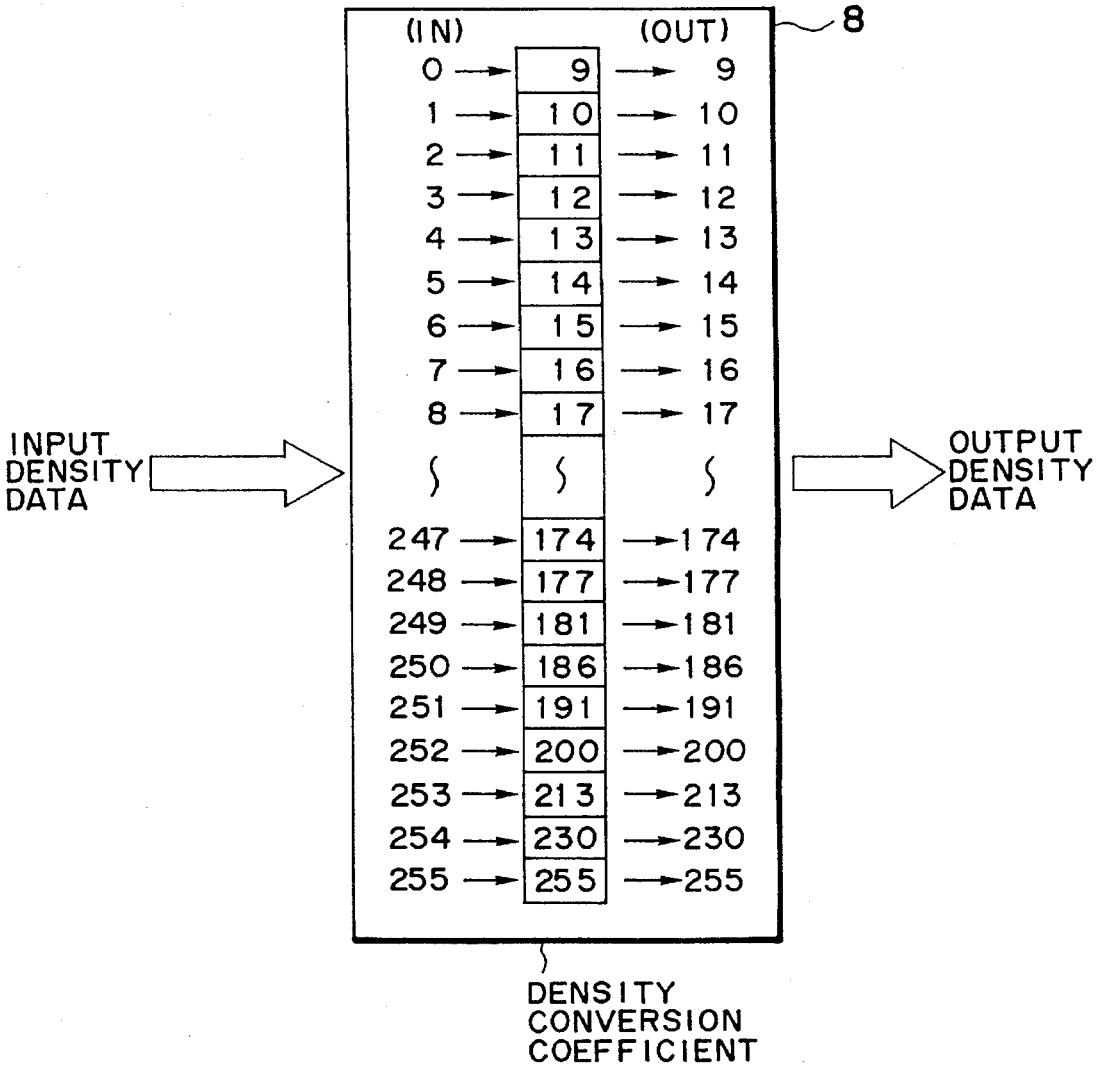
FIG. 14 is a schematic view showing the function of a density converter 308.
Figure 15:
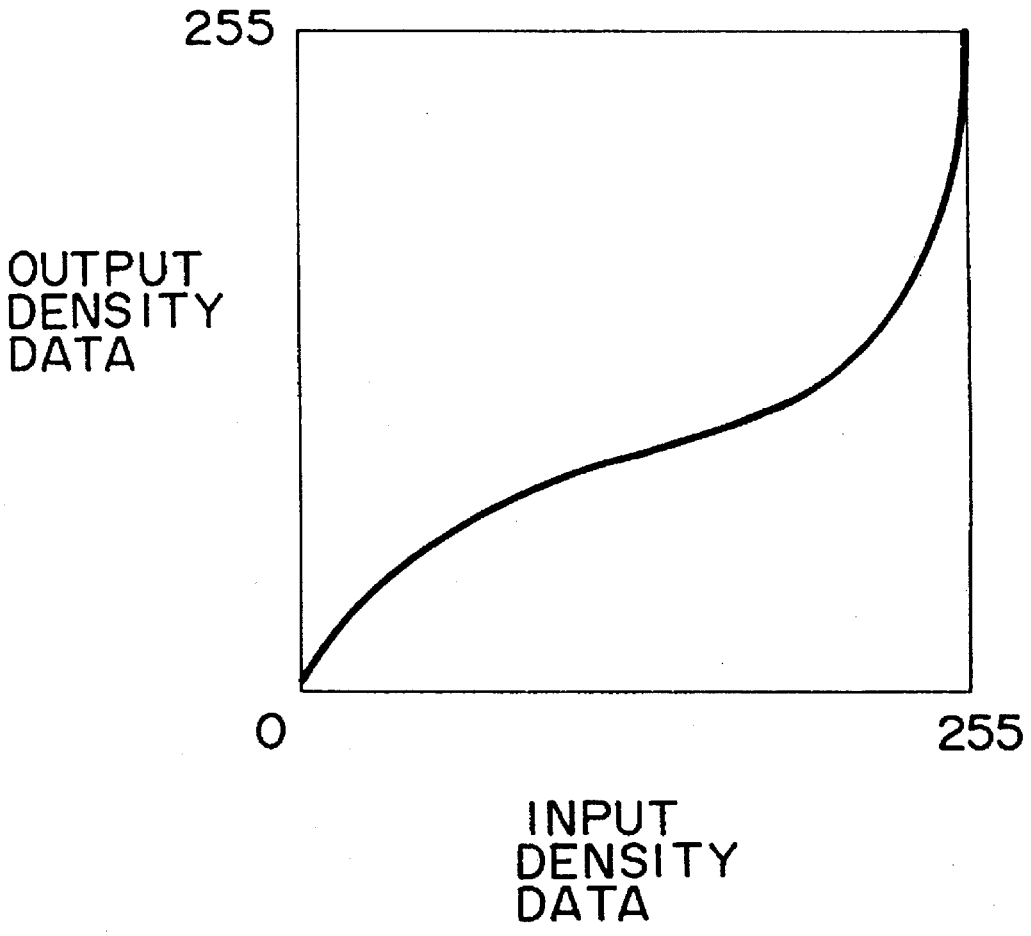
FIG. 15 is a chart showing the relation between the input and output density data in the density converter 308.

A density converter 308 is composed of a look-up table as shown in FIG. 14, and serves to convert the input density data of 256 levels into output density data of 256 levels so as to satisfy the relationship shown in FIG. 15. The function of said density converter will be explained with reference to FIG. 16. The abscissa for "input density data" in the 2nd quadrant can be considered equivalent to the original density, and is therefore preferred to be in linear relationship with the "copy density". On the other hand, the output density data in the ordinate, which determines the light amount of the laser beam and influences the surface potential of the photosensitive drum 320 as will be explained later, is correlated with the surface potential, depending solely on the sensitivity characteristic of the photosensitive drum 320, as indicated by a solid line in the 4th quadrant in FIG. 16. Said surface potential, which determines the deposited amount of toner and influences the copy density as will be explained later, is correlated with the copy density, depending solely on the development characteristic of the photosensitive drum 320, as indicated by a solid line in the 1st quadrant. Because of the above-mentioned characteristic of the photosensitive drum 320, if the input density data in linear relationship with the original density are used as the output density data for determining the light amount of the laser beam without any correction, the input density data are not linearly correlated with the copy density. A certain density correction is therefore needed for overcoming such situation. The density converter 308 serves to correct the density data in such a manner that the input density data become linearly correlated with the copy density as shown in the 2nd quadrant in FIG. 16.

A bus switch 328 selectively connects the D/A converter 312 either to the density converter 308 at the copying operation of the copying machine C, or to a digital data generator 329 (test pattern means) at the measurement of the surface potential and the reflective density of the photosensitive drum 320. Said digital data generator 329 controls a CPU 309 in such a manner as to generate digital data from a RAM 311, which in advance stores 17 sets of data corresponding to the density levels 0, 16, 32, . . . , 240, 255. The D/A converter 312 converts the digital signal into an analog signal, and a comparator 313 compares said analog signal with a triangular wave signal of a predetermined interval generated from a triangular wave generating circuit 314 and generates a pulse signal (hereinafter called binarized density signal). Said binarized density signal has a pulse duration proportional to the output density data released from said density converter 308. A laser driving circuit 315 oscillates a laser diode 316 for a period corresponding to the pulse duration of the pulse width modulated binarized density signal, thereby causing emission of a laser beam.

A polygon mirror 317, rotatably supported and driven at a high speed by unrepresented drive means, is positioned on the optical path of the laser beam emitted from said laser diode 316. A f-θ lens 318 and a mirror 319 are positioned on the optical path of the laser beam reflected by the polygon mirror 317, thereby irradiating the photosensitive drum 320 with said laser beam.

The cylindrical photosensitive drum 320 is rotatably supported and is driven in the direction of arrow by unrepresented drive means, and a primary charger 321, a potential measuring device 330, a developing device 323, a transfer device 324, a reflective density measuring device 332, a cleaner 327, and a charge-eliminating exposure device 322 are arranged, in this order, around said photosensitive drum 320.

The primary charger 321 is so-called corona discharger and is positioned parallel to the rotary axis of the photosensitive drum 320. The developing device 323 contains charged toner. The above-mentioned laser beam passes between said primary charger 321 and the developing device 323, and forms an electrostatic latent image on the external periphery of the photosensitive drum 320. The transfer device 324, serving to transfer the toner, deposited on the external periphery of the photosensitive drum 320, onto a sheet material P transported by unrepresented sheet transporting device, is provided with a transfer charger 325 and a separating charger 326 positioned on the rear side of said sheet material P. Both are composed of corona discharger, of which former serves to transfer the toner from the photosensitive drum 320 onto the sheet material P by an electrical force, while the latter serves to neutralize the charge given to the rear side of the sheet material P, thereby preventing the sheet material P from sticking to the external periphery of the photosensitive drum 320.

The cleaner 327 serves to eliminate the toner remaining on the photosensitive drum 320, and the charge eliminating exposure device 322 irradiates the external periphery of the photosensitive drum 320 with light, thereby neutralizing the charge thereon.

Figure 17:
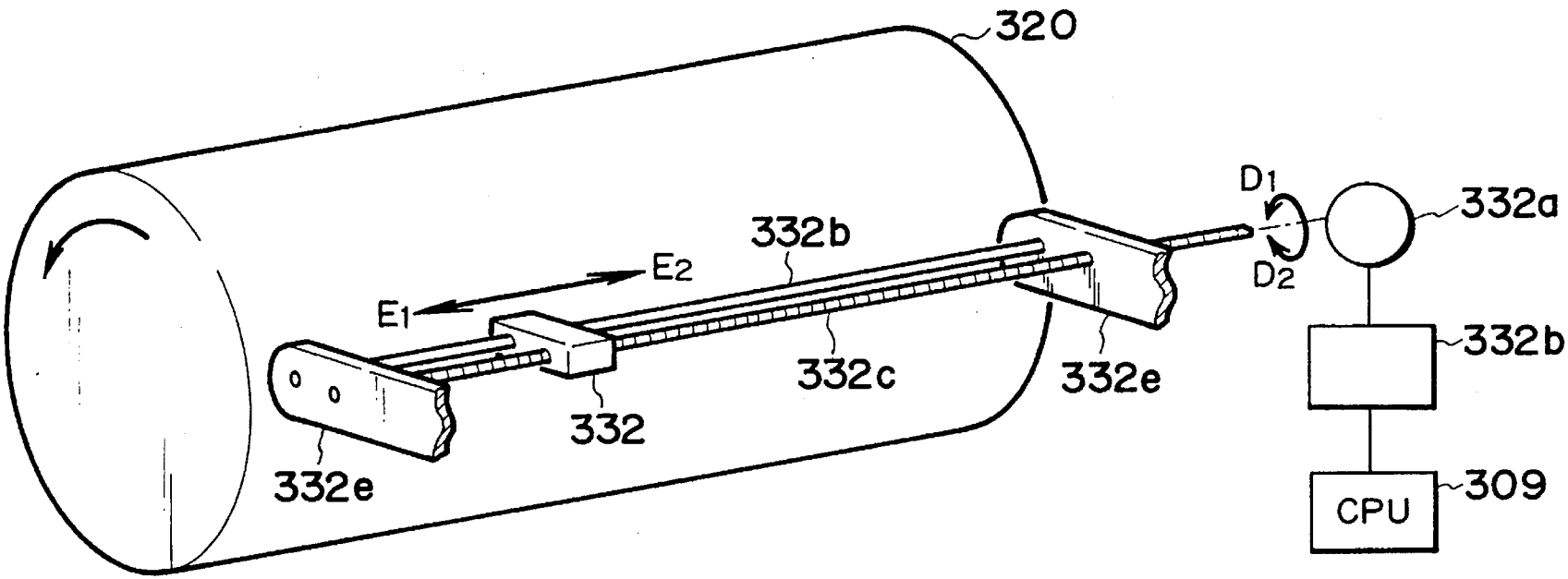
FIG. 17 is a schematic view of a support mechanism for a reflective density measuring device 332.

In the following there is explained, with reference to FIG. 17, a support structure for the reflective density measuring device 332.

In the vicinity of the photosensitive drum 320, a rod screw 332*c* and a guide rod 332*d* are supported, in parallel manner to the rotary axis of said photosensitive drum 320, by brackets 332*e*. Said rod screw 332*c* is rendered rotatable and is connected at an end to a motor 332*a*, which is connected to a power source 332*b* and is controlled by the CPU 309. Said motor 332*a* can rotate in the directions D1 and D2. The reflective density measuring device 332 is provided with two penetrating holes, and said guide rod 332*d* slidably passes through one of said holes while said rod screw 332*c* engages with the other, whereby the reflective density measuring device 332 is positioned opposed to the external periphery of the photosensitive drum 320. The rotation of the motor 332*a* in the direction D1 or D2 causes the rotation of the rod screw 332*c*, whereby the density measuring device 332 is moved in a direction E1 or E2.

The potential measuring device 330 is also supported in a similar manner, and the CPU 309 is provided with synchronization means 309*a* for driving the measuring devices 330, 332 in synchronization.

The potential measuring device 330 is of already known capacitance oscillation type, while the density measuring device 332 is also of a known type consisting of a light emitting device (such as LED) and a photosensor (such as photodiode). The light-emitting device has a wavelength of 960 nm, whereby the toner consisting of carbon black totally absorbs the emitted light, while the photosensitive member with an absorbing wavelength region of 500–800 nm does not absorb but reflects the emitted light.

As shown in FIG. 12, A/D converters 331, 333 are respectively connected to the measuring devices 330, 332 for converting the analog electrical signal from said devices into digital signals. When the potential distribution data and the reflective density distribution data in the form of digital signals are supplied to the CPU 309, control means 309*b* incorporated in the CPU 309 calcualtes a density conversion coefficient according to a program stored in advance in a ROM 310 and stores said coefficient in the density converter 308 and the RAM 311. The output density data from said density converter 308 are converted, as already explained before, into analog siganls in the D/A converter 312, then pulse width modulated in the comparator 313 and used for controlling the light amount of the laser beam.

In the following there will be explained the function of the above-explained embodiment.

As the light from the illuminating lamp 302 is reflected by the original document D, the amount of reflected light varies according to the original density (in fact the amount of reflected light is logarithmically related with the original density). Said reflected light is converted by the photoelectric converting device 305 into an analog electrical signal proportional to the amount of light (therefore, said electrical signal is also logarithmically related with the origianl density). Said analog signal is converted, as explained before, by the A/D converter 306 into a digital signal, which, after various corrections, forms density data 307 linearly correlated with the original density (cf. FIG. 13). Said density data 307 are subjected to density conversion in the density converter 308 (cf. FIG. 15), and is again converted into an analog signal by the D/A converter 312. Said analog signal is converted, by the pulse width modulation in the comparator 313, into the binarized density signal, according to which the laser driving circuit 315 controls the light-emitting time of the laser diode 316.

The obtained laser beam is reflected by the polygon mirror 317 and irradiates the external periphery of the photosensitive drum 320, scanning said periphery in the axial direction thereof due to the change in the angle of said mirror.

Figure 18:
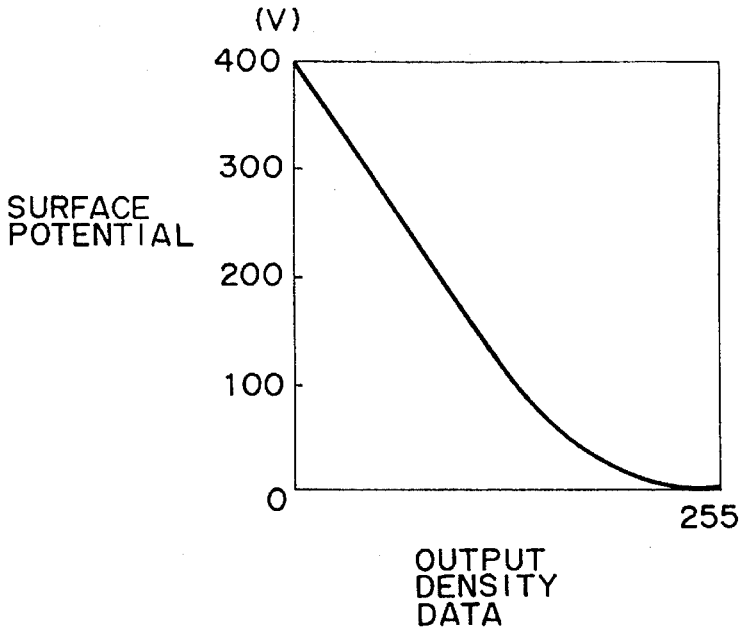
FIG. 18 is a chart showing the relation between the output density data of the density converter 308 and the surface potential of the photosensitive drum 20.
Figure 19:
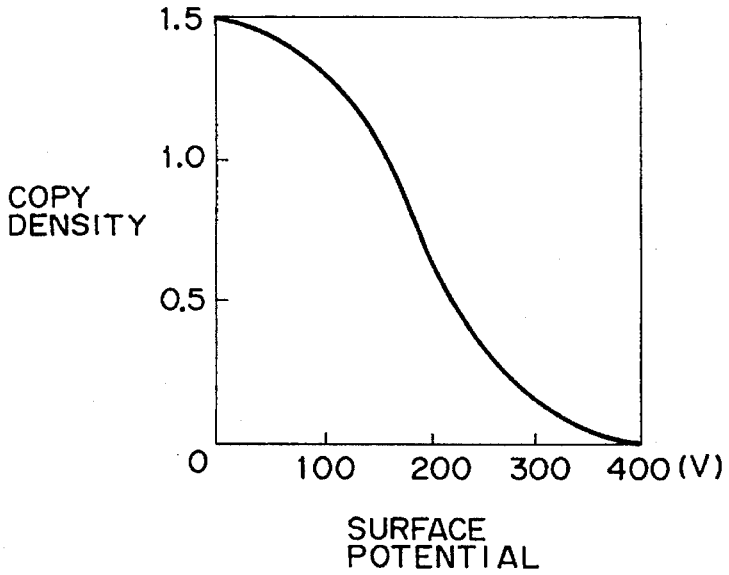
FIG. 19 is a chart showing the relation between the surface potential of the photosensitive drum 20 and the copy density.

The external periphery of said photosensitive drum 320 is charged to a constant potential by said primary charger 321, and is then irradiated by said laser beam, whereupon the surface potential of the irradiated portion varies locally according to the light amount of the irradiating laser beam. Thus the surface potential of the photosensitive drum 320 is determined corresponding to the output density data released from said density converter 308 (cf. FIG. 18), whereby an electrostatic latent image is fomred. Toner of an amount corresponding to the surface potential of said electrostatic latent image is deposited from the developing device 323 onto the periphery of the photosensitive drum 320, thereby forming a visible image. The toner thus deposited on the photosensitive drum 320 is peeled therefrom by the transfer charger 325, and is transferred as a visible image on the sheet material P, of which charge is neutralized by the separating charger 326. The deposited amount of said toner, or the copy density, varies according to the surface potential of the photosensitive drum 320, as shown in FIG. 19.

In the following there will be explained, with reference to FIGS. 20 and 21, a method for detecting and controlling the image forming ability of the photosensitive drum 320, primary charger 321 and developing device 323, utilizing the potential measuring device 330 and density measuring device 332.

Prior to the start of such detection, namely during the ordinary copying operation, said measuring devices 330, 332 are stopped at a position (axial measuring position 1 in FIG. 20) opposed to the left-hand end of the photosensitive drum 320.

Then, when the operator shifts the bus switch 328, the digital data generator 329 is connected to the D/A converter 312 (step S301). Thus the digital data stored in advance in the RAM 311 are released and converted into analog data by the D/A converter 312. Said analog data are pulse width modulated by the comparator 313, and the resulting binarized density signal is directly supplied to the laser driving circuit 315, which in response controls the light-emitting time of the laser diode 316, thereby controlling the amount of the laser beam. Since said laser beam irradiates the periphery of the photosensitive drum 320, there are formed, on said periphery, 17 electrostatic latent images constituting test patterns (FIG. 20), each of which is composed of 20 areas (hereinafter called patches) of 15×15 mm each. Said electrostatic latent image are developed in the developing device 323 to provide 17 visible images with different copy densities. The supply of the sheet material P is interrupted, while the transfer device 324 is deactivated, so that the reflective density of said visible images can be measured by the density measuring device 332.

After the formation of the test patterns on the photosensitive drum 320, the potential measuring device 330 and the density measuring device 332 respectively measure the potential distribution and the reflective density distribution in the patches (step S302) in the following manner.

Because of the rotation of the photosensitive drum 320, each small area in the periphery of said drum is at first charged to a constant potential in a rotational position opposed to the primary charger 321 having a charging wire 321*a*, then subjected to a change in the surface potential according to the amount of exposure to the laser beam, then faces the potential measuring device 330 after a predetermined time T1 from the exposure to the laser beam, and finally faces the density measuring device 332 after another time T2. Such times T1, T2 are determined in relation to the rotating speed of the photosensitive drum 320, and the timing of digital data generation is substantially same as the timing of exposure to the laser beam. Consequently, if the potential measurement is conducted at a time T1 from the digital data generation and the density measurement is conducted at a time T2 thereafter, the measuring devices 330, 332 measure a same small area as long as said devices are in a same "axial measuring position. The timing control of said measurements is executed by the CPU 309 incorporating the synchronization means 309*a*.

Consequently, in the measurements of the potential and reflective density of the above-mentioned test patterns, the 17 patches P(1, 1), P(1, 2), . . . , P(1,16 ), P(1,17) can be measured by maintaining the measuring devices 330, 332 at the axial measuring position "1", rotating the photosensitive drum 320 by a turn and controlling the timing of measurements by means of the CPU 309. The CPU 309 effects control in such a manner that the measurements are executed at the center of each patch.

Upon completion of the density measurement of the patch P(1, 17), the measuring devices 330, 332 are moved to a next axial measuring position "2" by a driving signal from the CPU 309, and measure the 17 patches P(2, 1), P(2, 2), . . . , P(2, 17) in said position.

All the patches in the test patterns are measured in this manner through successive movements of the measuring devices 330, 332, and the measured data are transferred to the CPU 309 and stored in the RAM 311.

Figure 20:
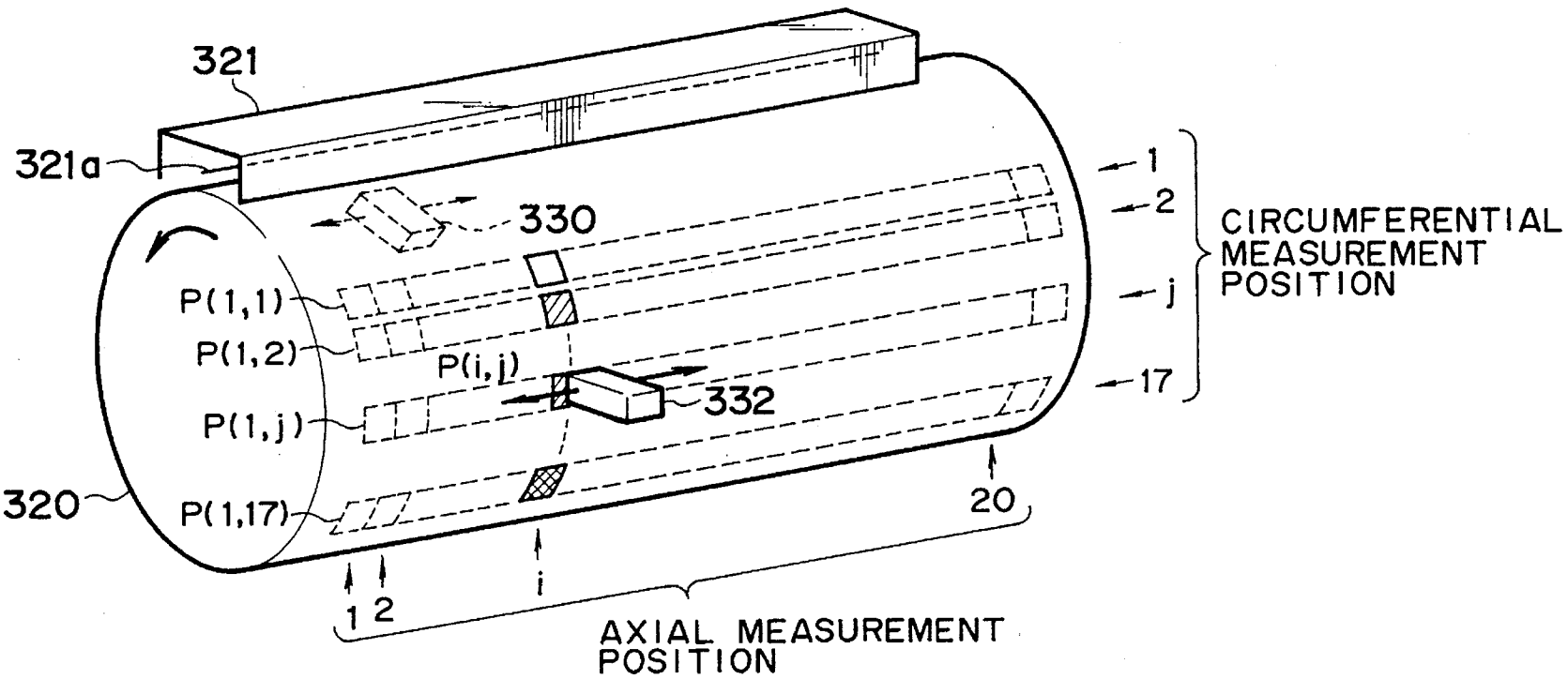
FIG. 20 is a schematic view showing the measuring position of a potential measuring device 330 and a reflective density measuring device 332.

A next step S303 (FIG. 21) calculates 20 sensitivity characteristic curves and 20 development characteristic curves, based on the data measured at 20 axial measuring positions (FIG. 20). The sensitivity characteristic curve is determined from the relation between 17 digital data stored in advance in the RAM 311 and 17 surface potential data obtained by the measurements, and the development characteristic curve is determined from the relative between said 17 surface potential data and the 17 reflective density data obtained from the measurements.

The method of calculation of these characteristic curves will be explained in the following with reference to FIGS. 22 and 23.

Figure 22:
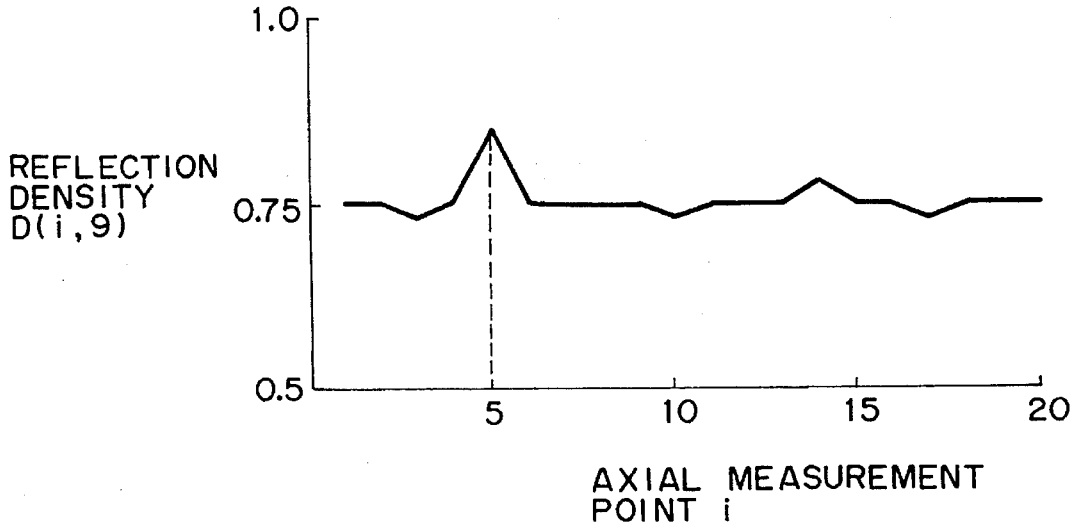
FIG. 22 is a chart showing an example of result of reflective density measurement.
Figure 23:
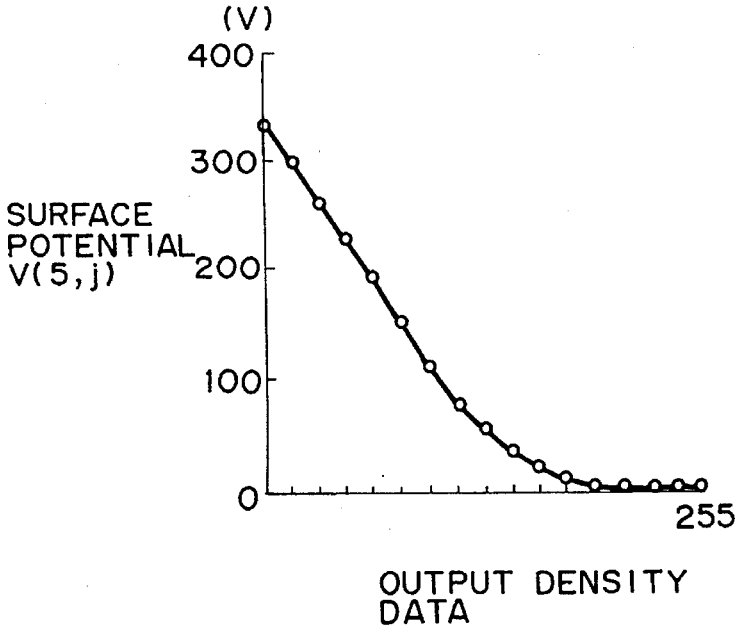
FIG. 23 is a chart showing the sensitivity characteristic curve of the photosensitive drum 320.

FIG. 22 is a graph showing the variation of reflective density among the patches, in a 9th test pattern among 17 test patterns. The illustrated data were obtained after 200,000 copies on A4-sized sheets under a temperature of 15° C. and a relative humidity of 10%. The abscissa indicates the axial measuring positions, while the ordinate indicates the reflective density of the patches for digital data of level 128. The data shows a higher density at the 5th patch from the left, resulting in an unevenness in density.

Figure 24:
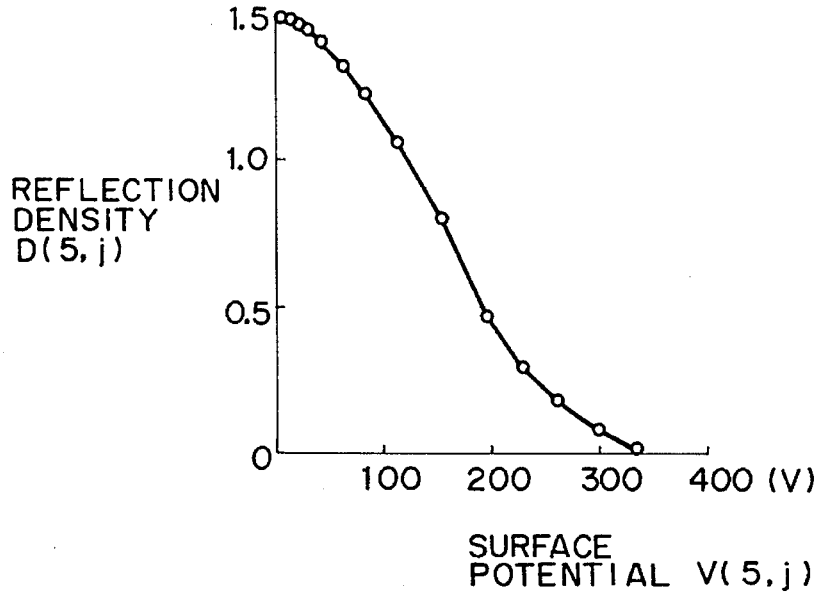
FIG. 24 is a chart showing the development characteristic curve of a development device 323.

Such data for reflective density are determined also for other 16 visible images, and also determined for the potential distribution. FIGS. 23 and 24 respectively show examples of the sensitivity characteristic curve and development characteristic curve for the 5th patch, combining these data. Each curve is determined from 17 sets of data, utilizing interpolation.

Figure 16:
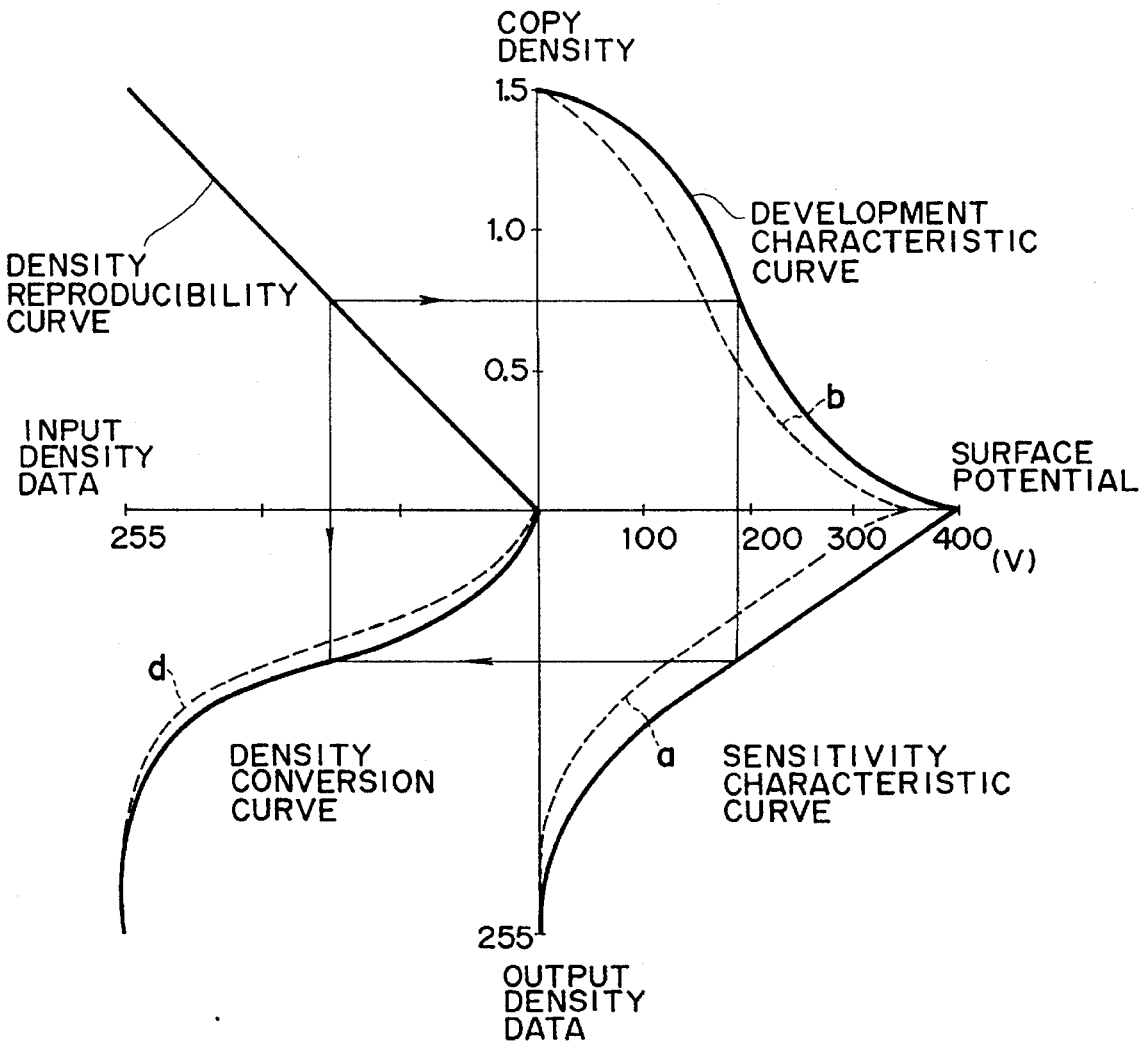
FIG. 16 is so-called Jones plotting of the system.

These characteristic curves, as indicated by broken lines a, b in the 4th and 1st quadrants in FIG. 16, are aberrated from those (solid lines) before the copying operation. The copy density is determined by these characteristic curves, based on the output density data as explained before. Consequently, if the density conversion by the density converter 308 is executed in the solid-lined form without any correction, the relation between the input density data and the copy density are affected by said aberrations in the characteristic curves and are no longer linear.

In order to avoid such drawback and maintain a linear relationship between the input density data and the copy density, a step S304 (FIG. 21) effects correction on the density conversion curve. A broken line d in the 3rd quadrant in FIG. 16 shows the density conversion curve after correction. Such correction is conducted also for other patches, maximum 20 in number.

A step S305 stores the density conversion coefficient, corresponding to the corrected density conversion curve, in the density converter 308. The density converter 308 is provided with a memory for storing conversion coefficients, 20 in number at maximum.

After these operations, the operator shifts the bus switch 328 to the density converter 308, whereby the copying operation is again enabled (step S306). In the copying operation, the latent image formation on the photosensitive drum 320 is executed, utilizing the density conversion coefficients at the different axial positions.

In the following there will be explained a case in which the development characteristic of the photosensitive drum 320 is extremely deteriorated as indicated by a curve in FIG. 25.

Figure 25:
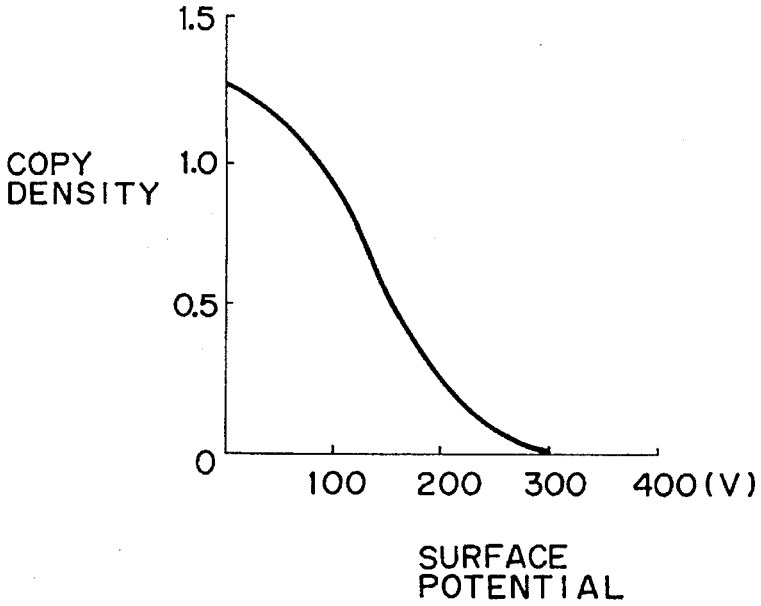
FIG. 25 is a chart showing the relation between the copy density and the surface potential.

In the state shown in FIG. 25, even if the amount of laser beam is maximized to reduce the surface potential to zero, the copy density can only reach 1.25 which is lower than the desired copy density. In such case a copy density exceeding 1.25 cannot be obtained by any correction by the density converter 308.

Figure 21:
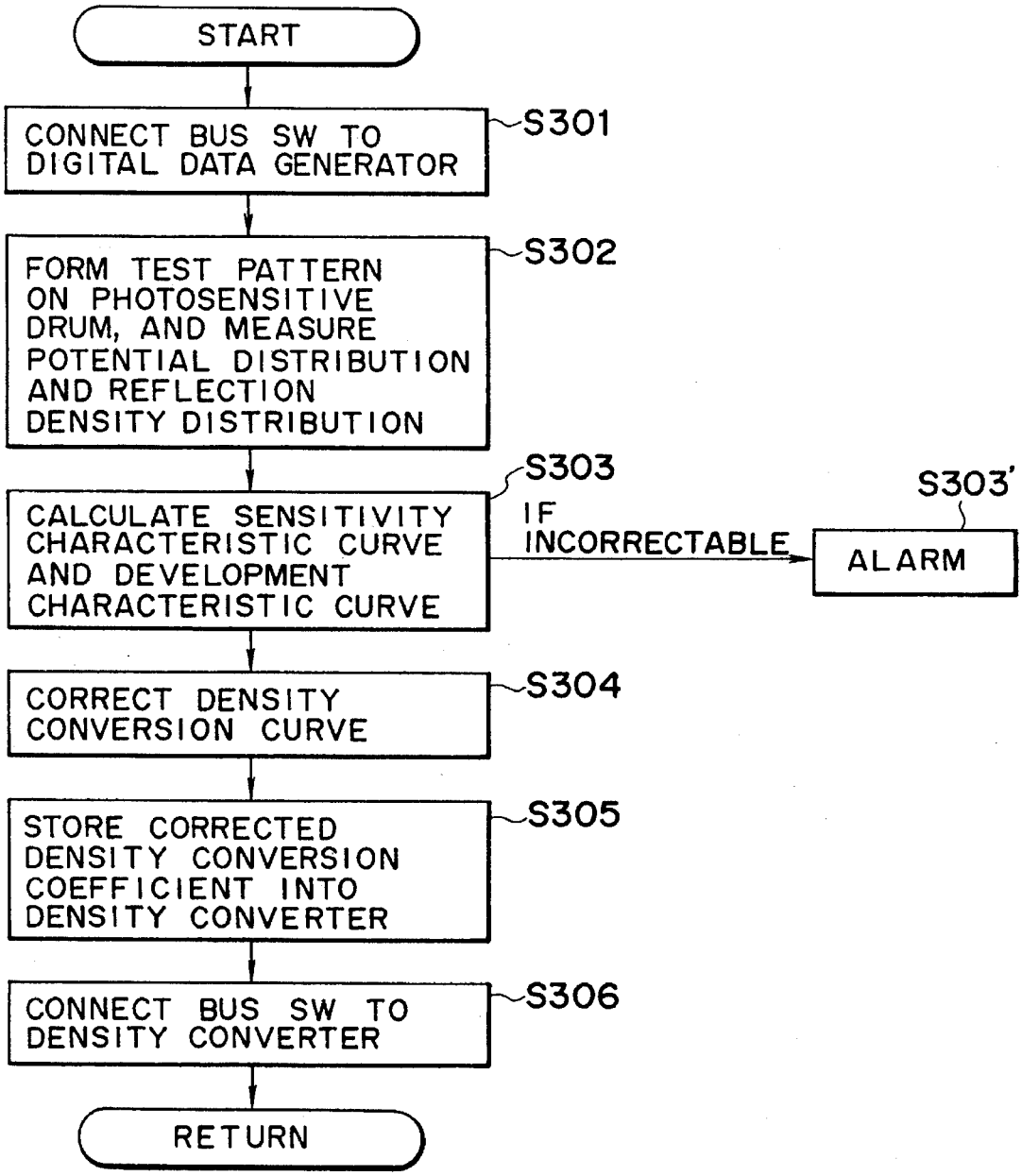
FIG. 21 is a flow chart of the method for detecting and controlling the image forming ability.

Consequently, in the present embodiment, a step S303 in FIG. 21 discriminates whether the copy density at the zero surface potential is lower than 1.5, and, if lower, identifies that the correction is impossible and gives an alarm for the abnormal state of the development means, for example by displaying an alarm message on the operation panel of the apparatus.

In this manner the results of potential measurement can be correlated with those of density measurement, and the copy density can be maintained in an appropriate relationship to the original density. It is therefore possible to prevent so-called background smear and to achieve density restoration within a short time.

Also since the variations in the sensitivity characteristic or development characteristic of the photosensitive drum 320 can be measured in plural positions (20 positions in the present embodiment) along the axial direction thereof, it is possible to detect and rectify the density unevenness in said axial direction. The service life of the photosensitive drum 320, primary charger 321 and developing device 323 can therefore be extended. In a continuous copying experiment conducted by the present inventors on A4-sized sheets under a temperature of 15° C. and a relative humidity of 15%, the unevenness in density did not appear until 400,000 copies and the service life of the photosensitive drum 320 etc. was considerably improved in comparison with the conventional mode in which the density unevenness appeared at 200,000 copies and exceeded the tolerable level at 250,000 copies.

Also in case the characteristic of the photosensitive drum 320 etc. is extremely deteriorated to a level unrecoverable by the correction of the conversion coefficient in the density converter 308, the operator can easily know the necessity for the replacement of the drum 320 etc. because an alarm therefor is provided.

During a full turn of the photosensitive drum 320, the electrostatic latent images are formed only in the axial positions corresponding to the measuring positions of the measuring devices 330 etc. and are not formed in other areas, under the control of the CPU 309 incorporating the position selecting means **309*b*. Since the developing device 323** develops the image only on the electrostatic latent images, the visible images are formed only in the measurement areas.

In a full turn of the drum 320, the laser beam irradiation is limited to 17 patches. Consequently the photosensitive drum 320 can be prevented from deterioration resulting from unnecessary laser beam irradiation, and the wasted consumption and scattering of toner are also minimized.

In the following there will be explained a variation of the 3rd embodiment.

The present variation is similar to the 3rd embodiment, except in the control by the CPU 309. More specifically, among 20 densities measured by the reflective density measuring device 332, if the density difference $|D(i, j)-D(i+1, j)|$ between two adjacent points is equal to or larger than $0.1\times n$ but less than $0.1\times(n+1)$, the section between said two points is equally divided into (n+1) sections and the density is measured on thus divided n points by the density measuring device 332.

This process will be explained with reference to FIGS. 26A and 26B.

Figure 26A:
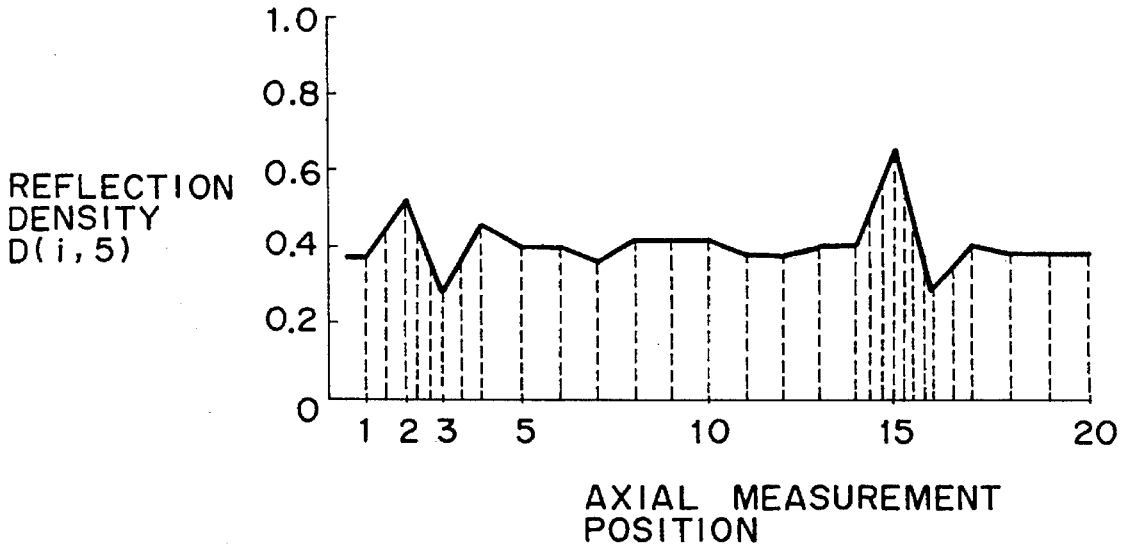
FIG. 26A is a chart showing an example of the result of reflective density measurement.
Figure 26B:
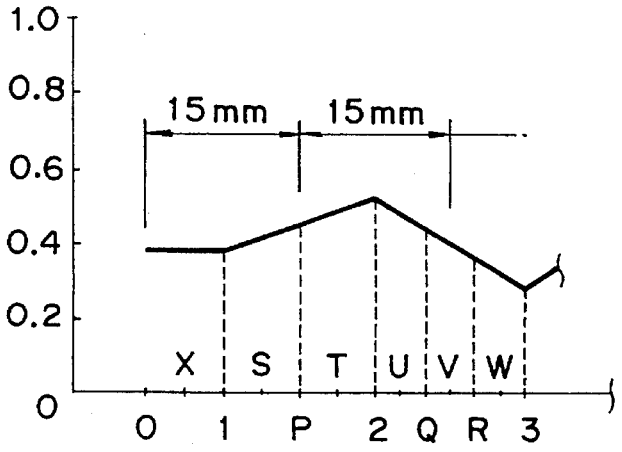
FIG. 26B is a similar chart in case the number of positions of measurement is increased.

FIG. 26A is a graph similar to that in FIG. 22 and showing the variation of reflective density in the patches, in a 5th test pattern among 17 test patterns formed on the photosensitive drum 320. The digital data used for forming said 5th test pattern are of a level "64", corresponding to a copy density of about 0.38 in the normal state. In the illustrated example, the densities at i=1 and i=2 are respectively 0.38 and 0.52, with a density difference $|D(1, 4)-D(2, 4)|=0.14$. As a relation $0.1\times n=0.1\times 1\leqq 0.14<0.1\times 2=0.1\times(n+1)$ stands, n=1 becomes satisfied so that the section between i=1 and i=2 is equally divided into two. Similarly the section between i=2 and i=3, having a density difference of 0.24, is divided into three. Such subdivisions are shown by broken lines in FIG. 26B, wherein a point P is the subdivision point between i=1 and i=2, and Q, R are the subdivision points between i=2 and i=3. A point S is the center point of the subdivided section 1-P, while T, U, V, W are center points of the subdivided sections P-2, 2-Q, Q-R, R-3, all representing new measuring points.

The reflective density is measured at said new measuring positions, at the center points of the subdivided sections defined by broken lines, and the density correction for the subdivided sections, including the new measuring points, are conducted on thus obtained data. The new measuring positions and subdivided sections are stored in the RAM 311, and are used in the correcting operation by the CPU 309.

This method enables appropriate correction even when the change in reflective density is significant within a patch (15×15 mm), as the reflective density is measured at a finer pitch and the density correction is made for each smaller area.

Also since the pitch of measuring points need not be selected fine from the beginning, the capacity of the memory need not be increased and the apparatus can be made inexpensively. According to this variation, in a continuous copying test with A4-sized sheets under a temperature of 15° C. and a relative humidity of 15%, the unevenness in density did not appear until 500,000 copies, with an improvement in the service life.

In the above-explained variation, in an end section 0-1 of the photosensitive drum 320, it is also possible to select the center point X of said section as a new measuring position and to effect correction based on the data obtained at said point X.

Figure 27:
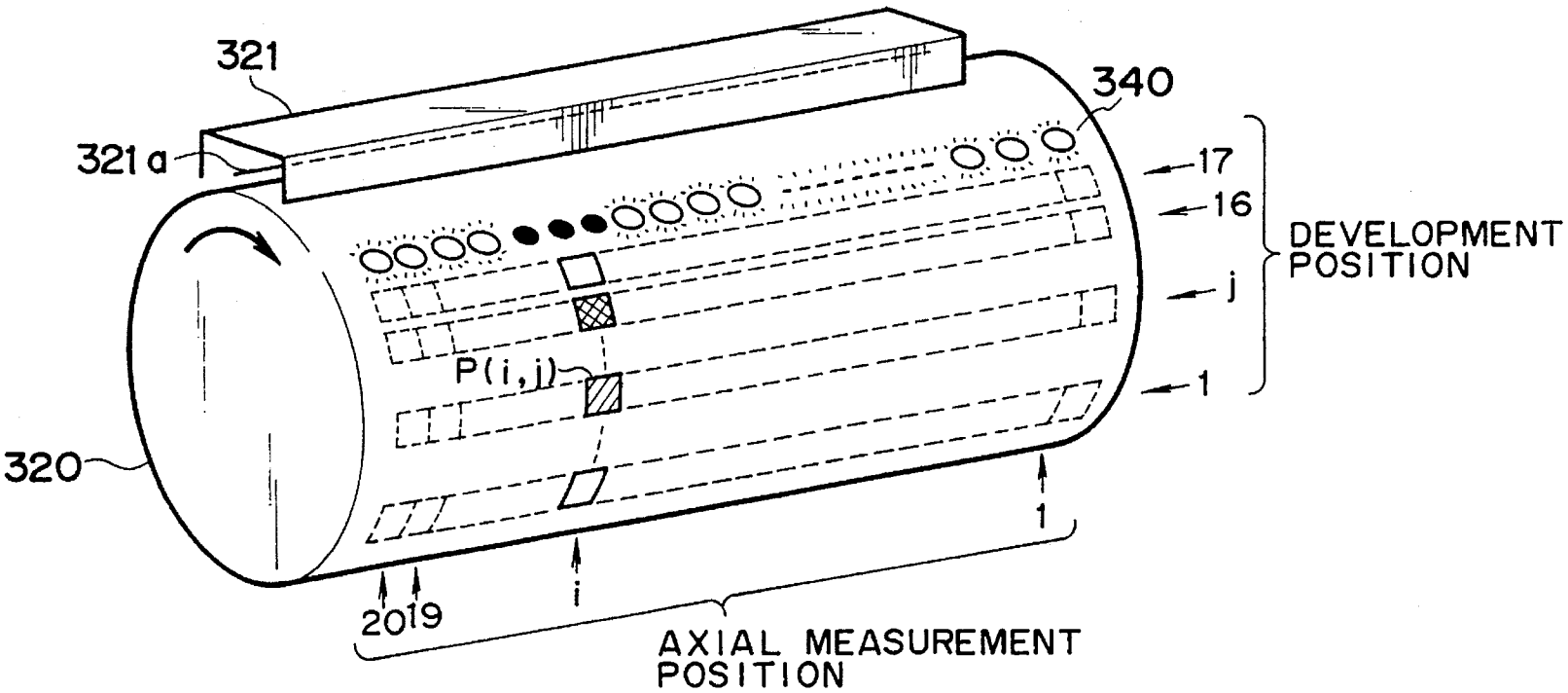
FIG. 27 is a schematic view showing the positions of measurement in a variation of the 3rd embodiment.

Now reference is made to FIG. 27 for explaining another variation of the 3rd embodiment.

The present embodiment employs normal developing method. The photosensitive drum 320 is rotated in a direction indicated by an arrow, and the developing device 323 (not shown in FIG. 27) is positioned corresponding to the 16th column of patches. The exposure device 340, consisting of a laser or an LED array, is positioned between the primary charger 321 and the development device 323, and is divided into 20 sections along the axial direction of the drum 320, respectively corresponding to the patches. Each of the divided sections of the exposure device 340 can be independently turned on and off, and, in the measurement of an i-th patch of the drum 320 from the right hand end, a section of the exposure device 340 corresponding to said i-th patch and two neighboring sections are turned off (non-exposure) by unrepresented control means. The measured patch is irradiated with the latent beam, based on digital data as explained before to form an electrostatic latent image, which is subsequently developed by the development device 323 into a visible image. FIG. 27 illustrates a state in which the patches from 1st to 16th rows have been made visible.

In the above-explained configuration, the laser beam irradiates in succession patches in an area uniformly charged by the primary charger 321 and in an axial position corresponding to the measuring devices, thereby forming 17 electrostatic latent images by the full turn of the photosensitive drum 320. The exposure device 340 effects charge elimination by exposure, excluding an area in the vicinity of the patch subjected to said laser beam irradiation. Consequently, despite of the normal development method, the development device 323 forms the visible image only in the vicinity of said patch subjected to said laser beam irradiation, but not in other areas.

Thus the wasted consumption of toner can be avoided also in the normal developing method, as the image development is not conducted in the areas of the photosensitive drum 320, not used for the measurements of potential etc.

Also since the exposure device 340 does not expose the patches adjacent to the patch subjected to the laser beam irradiation, said last patch is not erroneously exposed even without light shield means between the divided portions of the exposure device 340, and the accuracy of measurement by the measuring devices 330 can be improved.

Furthermore, the on/off operations of the divided portions of the exposure device 340 are conducted in succession from an end to the other of the photosensitive drum 320, corresponding to the axial measuring positions thereof. Consequently the different portions on the external periphery of the photosensitive drum 320 are substantially uniformly exposed by the exposure device 340, without local photodeterioration.

In the foregoing description, the exposure device 340 is divided into twenty sections, but the number of such division is naturally not limitative.

Also in the foregoing embodiment, the exposure by the exposure device 340 is turned off for the patches adjacent to the patch to be measured, in order to prevent intrusion of light thereto. Therefore, if the light shielding between the patches is improved by means of the known light shielding means, the exposure may be turned off only on the patch to be measured.

Furthermore, in the foregoing embodiment, the exposure by the exposure device 340 is conducted after the laser beam irradiation, but the sequence may be inverted. Thus the bland exposure by the exposure device 340 may be conducted immediately after the charging by the primary charger 321.

Furthermore, the exposure device 340 may be so designed to expose the spaces between the patches subjected to the laser beam irradiation, along the axial direction of the photosensitive drum 320.

Furthermore, the exposure device 340 may be replaced by a charge shielding plate which is positioned between the primary charger 321 and the photosensitive drum 320 and is divided along the axial direction thereof, corresponding to said patches and rendered independently operable.

The foregoing embodiment employs 17 sets of digital data corresponding to the levels 0, 16, 32, . . . , 255, but the number of sets of said digital data may naturally be decreased or increased. However, an increased number enables more appropriate control but requires a longer processing time and a larger toner consumption, while a decreased number allows to reduce the memory capacity thereby lowering the cost of the apparatus but involves increased danger of erroneous control since the interpolation of the characteristic curve has to be made for example with a third-order curve.

Furthermore, the foregoing embodiment employs 20 patches in consideration of the axial dimension (30 mm) of the photosensitive drum 320, but such number of patches is by no means limitative.

Furthermore, the above-explained device for detecting and controlling the image forming ability is applicable not only in a monochromatic image forming apparatus but also in a color image forming apparatus employing toners of different colors, and an image forming apparatus of cartridge type in which the photosensitive drum and the process devices therearound are formed as a replaceable unit.

According to the present invention, as explained in the foregoing, the results of measurements by the potential measuring device and the reflective density measuring device can be mutually correlated, so that the copy density can be controlled in an appropriate relationship to the original density, despite of the deterioration in the characteristic of the image bearing member or the like. It is therefore rendered possible to prevent so-called background smear, and to shorten the time required for density recovery.

Also the unevenness in density in the axial direction of the image bearing member can be detected, since the variations in the sensitivity and development characteristics on the periphery of said image bearing member can be measured in different positions along the rotary axis thereof.

Furthermore, as the control means controls the aforementioned latent image forming means based on the results of measurements, there can be obtained copy density faithful to the original density, irrespective of eventual fluctuations in the sensitivity and other characteristics.

Furthermore, the test patterns are formed only in the portions of periphery of the image bearing member, opposed to the potential measuring device and the density measuring device in the course of rotation of the image bearing member, but not formed in other unnecessary areas. Consequently there can be avoided unnecessary exposure for latent image formation, and the unnecessary photodeterioration of the image bearing member. Also unnecessary consumption of toner can be avoided since the image development only takes place in the test patterns.

[4th embodiment]

Figure 28A:
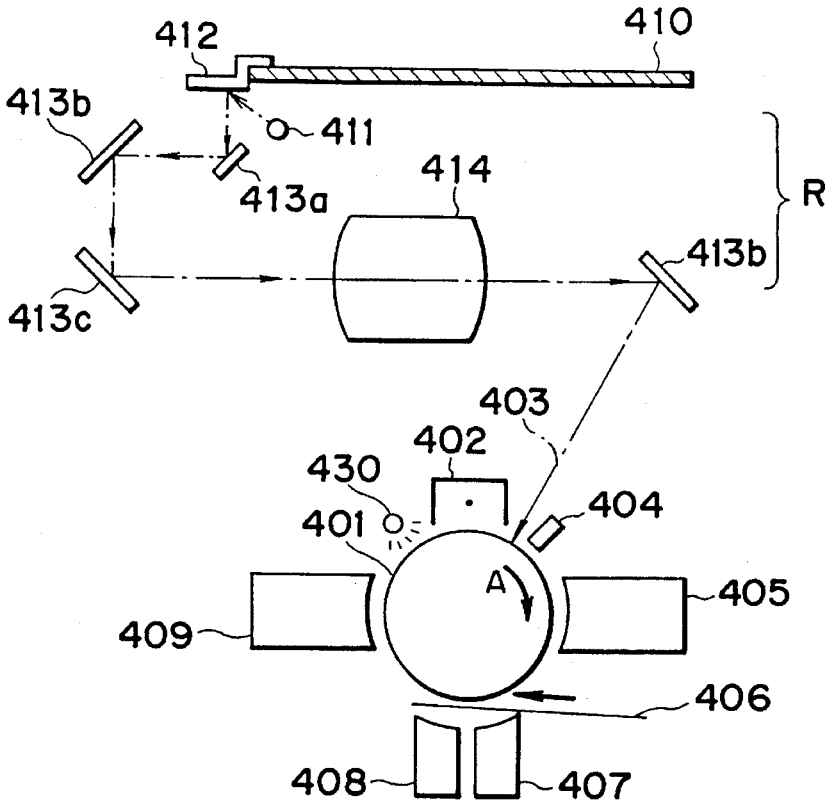
FIG. 28A is a schematic view of a 4th embodiment of the present invention applied to a copying machine.

In the following there will be explained a 4th embodiment of the present invention with reference to the attached drawings. FIG. 28A is a lateral view of the present embodiment in which the present invention is applied to a copying machine equipped with a cylindrical photosensitive member 401 rotated in a direction A. The photosensitive member 401 is charged by a corona charger 402, and is exposed to an optical image 403 to form an electrostatic latent image on the surface of the photosensitive member 401. Said latent image is subjected to toner deposition by a development device 405, thereby being converted into a visible toner image.

In synchronization with said toner image, a transfer material 406 is introduced from the outside, then said toner image is transferred onto said transfer material 406 by means of transfer means 407, and the transfer material 406 is separated from the photosensitive member 401 by separating means 408. Subsequently the transfer material is transported, through an unrepresented path, to an unrepresented fixing device, for fixing said toner image.

Above the photosensitive member 401 there is provided a platen glass 410 for supporting an unrepresented original document, and, below said platen glass 401, there are provided exposure means R consisting of an exposure lamp 411, mirrors 413*a*–413*d* and an imaging lens 414. Said exposure lamp 411 illuminates the original document, and the light reflected therefrom provide the above-mentioned optical image 403. At an end of the platen glass 410 there is provided a standard density board 412 which will be explained later.

Around the photosensitive member 410 and between the irradiating position of the optical image 403 and the development device 405, there is provided a potential sensor 404 for detecting the surface potential distribution of the photosensitive member 401 after charging.

Figure 29:
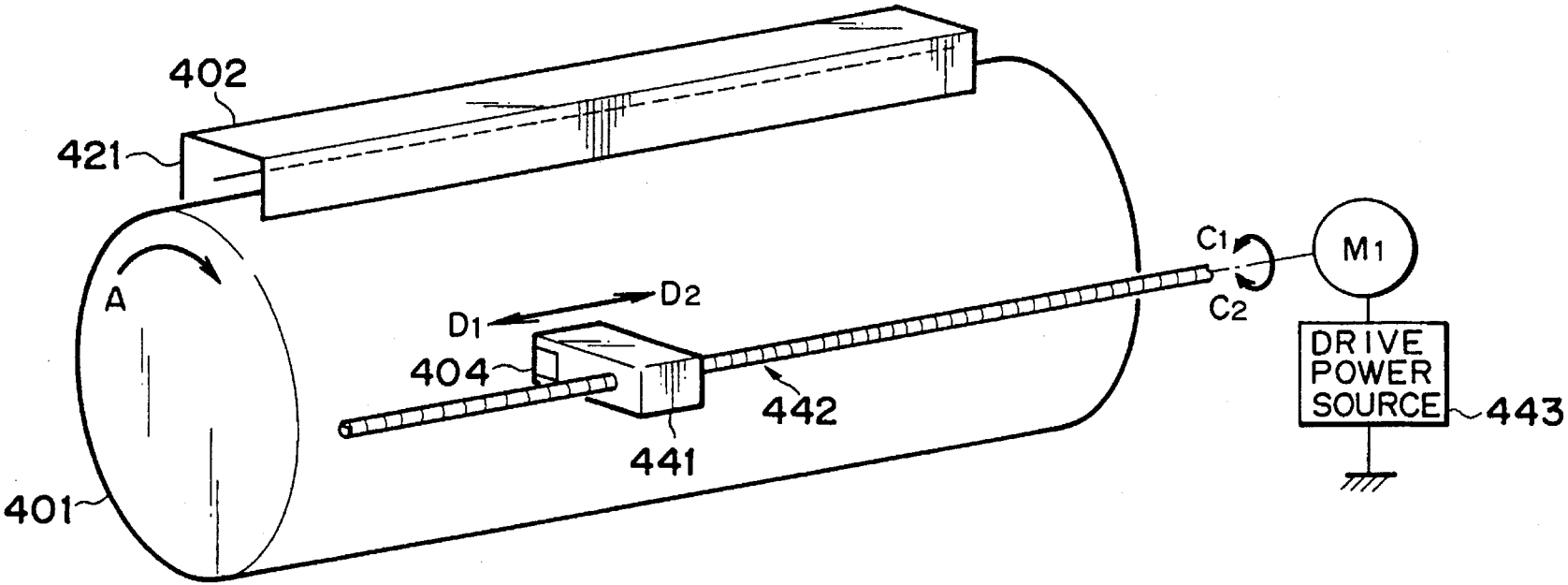
FIG. 29 is a perspective view of a potential sensor employed in the 4th and 5th embodiments.

FIG. 29 shows the details of the potential sensor 404. Close to the photosensitive member 401 there is provided the corona charger 402, equipped with a discharge wire 421 extended in the axial direction of the photosensitive member. At the downstream side of said corona charger 402 in the rotating direction, there is provided the potential sensor 604 of capacitance oscillation type, fixed on an insulating block 441 having a female screw. Said block is maintained in an unrotating state and engages with a screw rod 442 which extends parallel to the axis of the photosensitive member 401 and is rotated in a direction C1 or C2 by a motor M1, whereby the potential sensor 404 can scan the photosensitive member 401 in a direction parallel to the axis thereof. The motor is provided with a driving power source 443. In this manner the potential distribution of the photosensitive member 401 can be measured in the axial direction thereof.

Figure 28B:
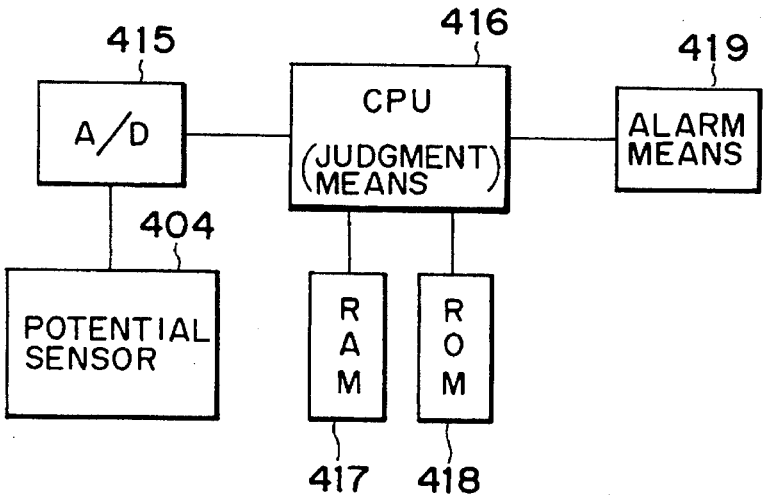
FIG. 28B is a block diagram of the principal circuit structure of said 4th embodiment.

FIG. 28B is a block diagram showing the principal circuit structure of the present embodiment, wherein shown are an A/D converter 415 connected to the potential sensor 404; a CPU 416 for processing the input data from the potential sensor 404 and discriminating the necessity for the maintenance of the corona charger 402; a RAM 417 for calculation process; a ROM 418 storing programs for data processing and for discrimination; and alarm means 419 for indicating, for example by a lamp, an alarm in case the CPU 416 identifies that a maintenance is required.

Figure 30:
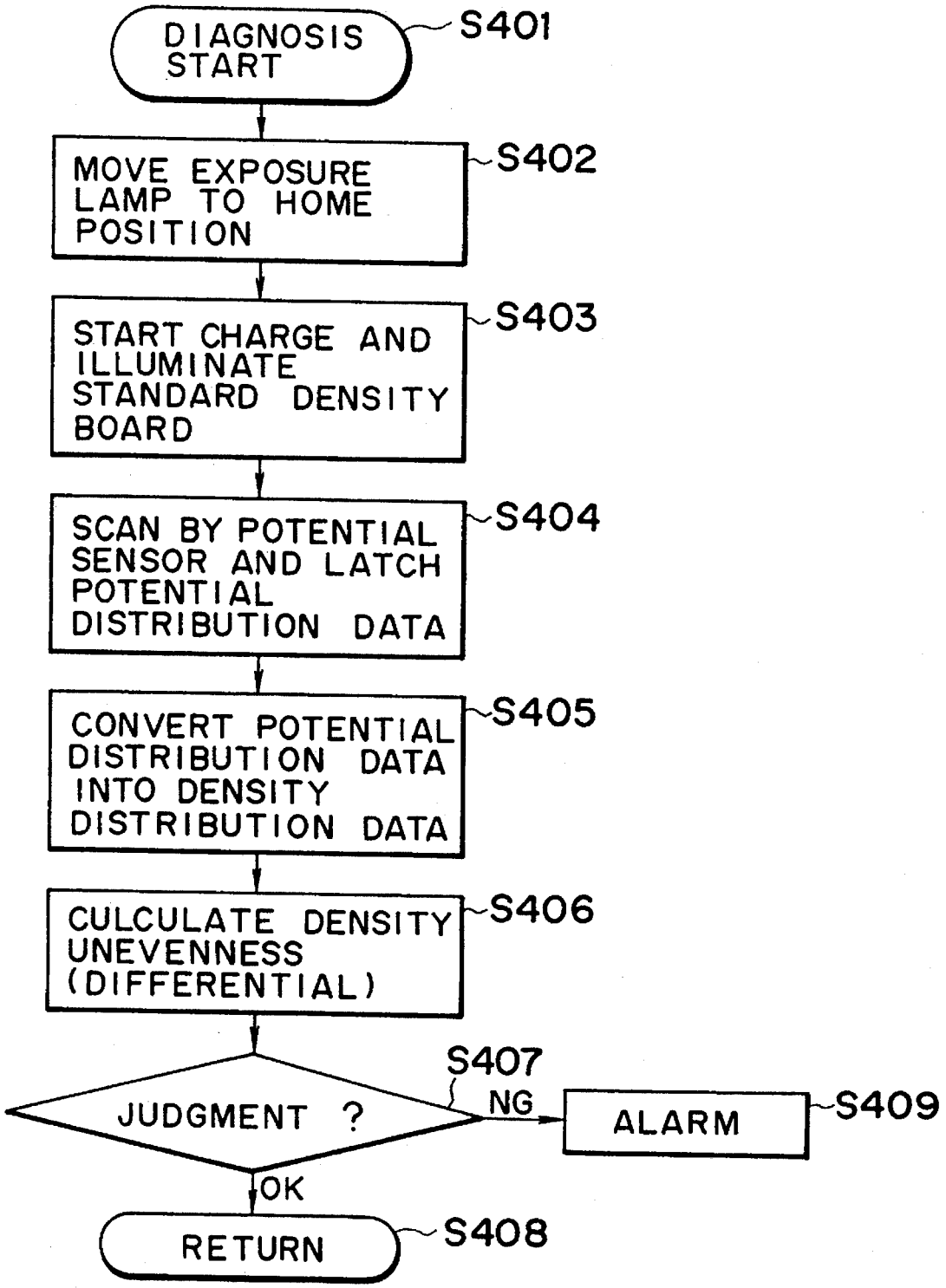
FIG. 30 is a flow chart of the control sequence of the 4th embodiment.

Now reference is made to a flow chart shown in FIG. 30 for explaining a process of diagnosis (collectively calling detection and discrimination of the present invention). At first a step S401 starts the diagnosis, preferably at the start of power supply. The diagnosis requires a certain time during which the copying operation is disabled. Therefore, the diagnosis during the copying operation will interrupt such copying operation and is inconvenient. However, since such copying machine generally employs a fixing device utilizing a heating roller, the loss of time can be prevented if such diagnosis is conducted during the warning-up period of such heating roller.

A step S402 moves the exposure lamp 411 to the home position, at which, as shown in FIG. 28, the standard density board 412 is irradiated.

A step S403 applies a high voltage to the corona charger 402 to effect charging, and the exposure lamp 411 is simultaneously turned on to illuminate the standard density board 412. Said standard density board 412 is mounted next to the platen glass 410, composed of a metal plate of a same width as the platen glass 410, and is coated in uniform halftone with a reflective density of 0.2 to 0.6. Such uniform halftone density is employed because the image defect resulting from uneven discharge appears most conspicuously on a copy of such uniform halftone density. Instead, there may be employed a standard density board of uniform white color and the lighting voltage of the exposure lamp may be reduced (lamp intensity being reduced) in such a manner that the amount of light received by the photosensitive member is equivalent to that received from the halftone board.

A step S404 fetches the potential distribution data. The potential sensor 404 effect a scanning motion to measure the potential distribution on the photosensitive member 401, and the obtained data are stored in a RAM 417. The precision of diagnosis is improved with the increase in the number of measuring points, but, in the present embodiment, 20 points (interval of 15 mm) are selected for a scanning width of 300 mm. During the measurement, the image development is suspended in order to avoid unnecessary toner consumption, while the feeding of transfer material is also interrupted, and the charge elimination lamp 430 and the corona charger 402 alone are operated. The photosensitive member 401 is made to continue to rotate, since, if the rotation is stopped, the potential drops during the scanning motion because of the dark decay of the photosensitive member so that the measurement becomes impossible. The on/off states of the various units around the photosensitive member in the diagnostic mode are summarized in Table 1.

TABLE 1

| UNIT | ON/OFF STATE |
|---|---|
| Photosensitive member | ON (rotated) |
| Corona charger | ON |
| Exposure lamp | ON |
| Development device | OFF |
| Sheet feeding | OFF |
| Transfer device | OFF |
| Separating device | OFF |
| Cleaner | ON |
| Charge-elimination lamp | ON |
| Potential sensor | ON (scanning) |

Figure 31:
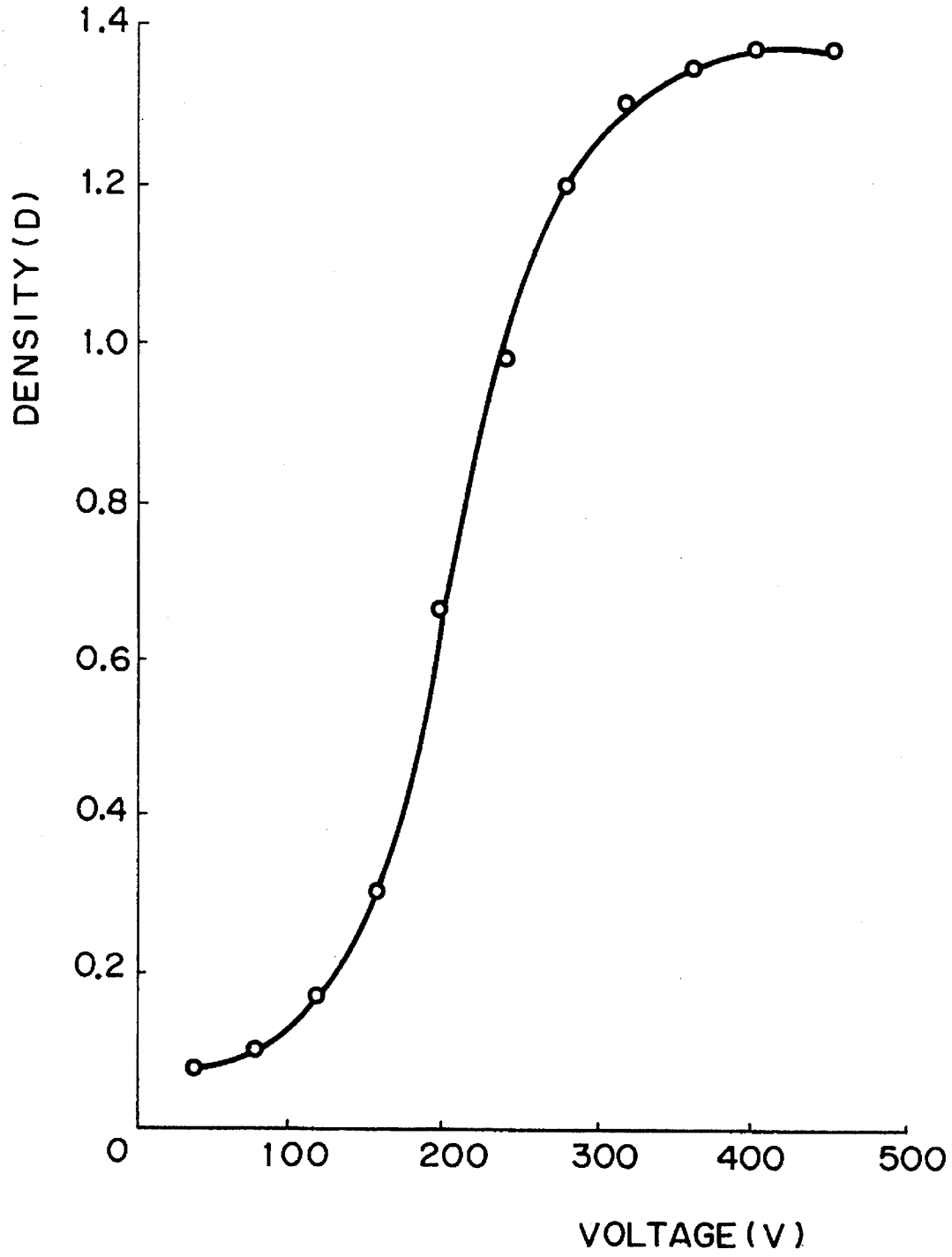
FIG. 31 is a chart showing the relation between the surface potential of the photosensitive member and the visible image density in the 4th and 5th embodiments.

A step S405 converts the entered potential distribution data into density distribution data, because the level of density unevenness has to be discriminated as the image defect appears in the form of density unevenness. FIG. 31 shows a voltage-density conversion curve (V-D curve) which is determined by the development characteristic of the apparatus, and is experimentally determined in advance and stored in the ROM 418.

A step S406 calculates the level of density unevenness. In the present embodiment, the differentiated value of distribution of density is employed as a variable representing the density unevenness. This method is preferred because the human being tends to recognize the density unevenness more conspicuously as the change in density becomes steeper even for a same amount of change in density.

Figure 32A:
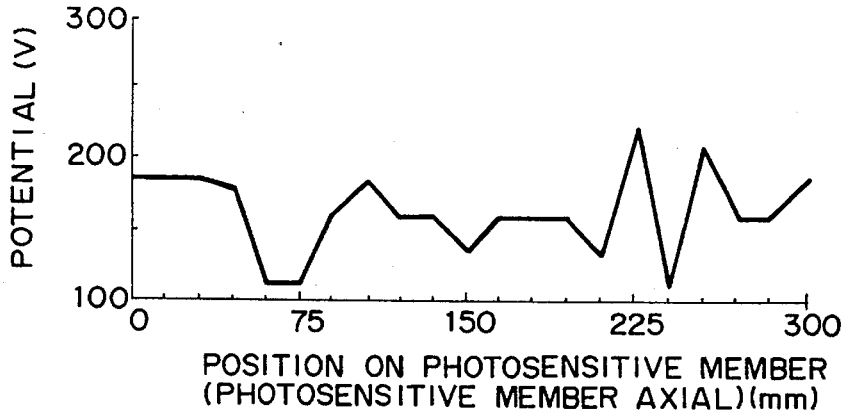
FIG. 32A is a chart showing the potential distribution as a function of the position on the photosensitive member.
Figure 32B:
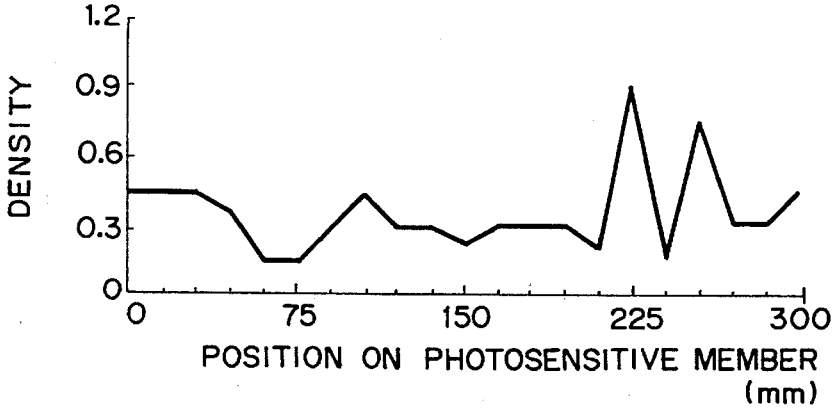
FIG. 32B is a chart showing the visible image density as a function of the position on the photosensitive member.
Figure 32C:
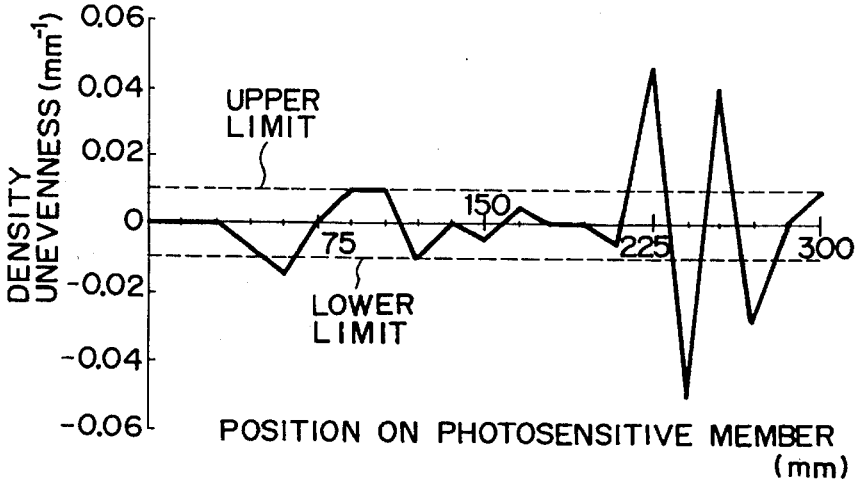
FIG. 32C is a chart showing the method for identifying the unevenness in the visible image density distribution.

FIGS. 32A to 32C show the processing of the input data in the steps S405 and S406. The data were taken with the present copying machine, after 250,000 copying operations with A4-sized plain copying sheets, under a temperature of 20° C. and a relative humidity of 10%. FIG. 32A shows the potential distribution data entered by the scanning operation of the potential sensor, while FIG. 32B shows the density distribution data converted from the potential distribution data shown in FIG. 32A, by means of the voltage-density conversion curve shown in FIG. 31, and FIG. 32C shows a density unevenness distribution curve obtained by differentiating the density distribution curve shown in FIG. 32B.

A next step S407 discriminates whether maintenance work is necessary, by comparing the density unevenness distribution with a predetermined threshold value (tolerance limit for density unevenness) as shown in FIG. 32C. In this case, the threshold value is selected at 0.01 $mm^{-1}$, corresponding to a density variation of 0.15 for a distance of 15 mm in the scanning direction. According to this discrimination, the density unevenness in FIG. 32C is identified as not acceptable, namely requiring maintenance. If the result of diagnosis is acceptable, not requiring maintenance, the sequence proceeds to a step S408, and the diagnosis is conducted again at the next warming-up step. If said result is not acceptable, a step S409 provides an alarm for the necessity of maintenance, for example on the operation panel of the apparatus. In response to this alarm, the user can request the maintenance service.

Continuous copying tests were carried out with a copying machine incorporating the above-explained diagnostic device, under a temperature of 20° C. and a relative humidity of 10%. Tab. 2 shows the number of copies at which the alarm was generated by said diagnosis, and the number of copies at which an image defect was generated when the copying operation was continued after said alarm generation. The encountered image defect is written in the parentheses. The discharge wire was replaced to new one at each test.

TABLE 2

| TEST NO. | No. 1 | No. 2 | No. 3 |
|---|---|---|---|
| COPY NUMBER AT ALARM GENERATION (10,000) | 20 | 21 | 22 |
| COPY NUMBER AT IMAGE DEFECT GENERATION (10,000) | 21 (white streak) | 21.5 (black streak) | 23 (abnormal discharge) |

As will be apparent from Tab. 2, the incorporation of diagnostic device allows to appropriately identify the timing of maintenance.

As explained in the foregoing, a diagnostic device employing the potential distribution detecting means and the discrimination of density unevenness enables to automatically identify the timing of maintenance, thereby improving the efficiency of maintenance and preventing the deterioration of image quality or the abnormal discharge.

[5th embodiment]

Figure 33A:
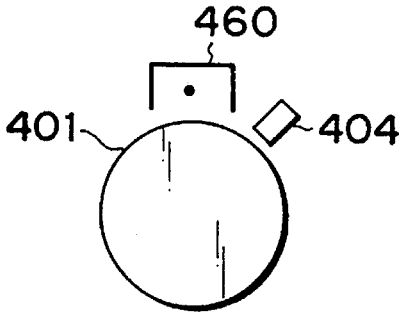
FIG. 33A is a partial view of the 5th embodiment.
Figure 33B:
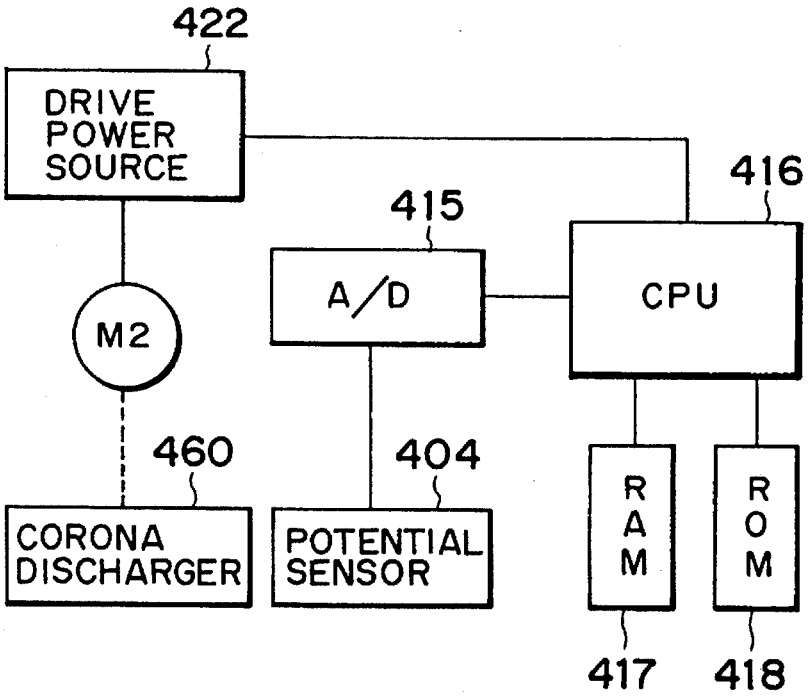
FIG. 33B is a block diagram of the principal circuit structure of said embodiment.

In the following there will be explained a 5th embodiment with reference to FIGS. 33A and 33B, which are respectively a schematic view of structure and a block diagram of circuit. However the optical system and a part of the image forming units around the photosensitive member are omitted. In the present embodiment, the potential distribution is detected in the same manner as in the 4th embodiment, but the accuracy of density unevenness discrimination is improved, and the wire of a corona charger 460 is automatically replaced in case the result of discrimination is identified as not acceptable, so that the maintenance work can be dispensed with.

The density unevenness is detected, in the 4th embodiment, by a steep density variation over a scanning distance of 15 mm, but, in the present 5th embodiment, the accuracy is improved by considering also the density variation over a distance longer than 15 mm. More specifically, this method is executed by calculating the density differences on the density distribution data D1, D2, . . . , Di, . . . , D20 (i indicates the number of potential measuring point, and Di indicates the density at a position of i×15 mm) in the following manner:

density difference between D1 and D2~D20;

density difference between D2 and D3~D20;

density difference between Di and Di1~D20;

density difference between D19 and D20; and comparing said density differences with a predetermined threshold values.

Figure 35A:
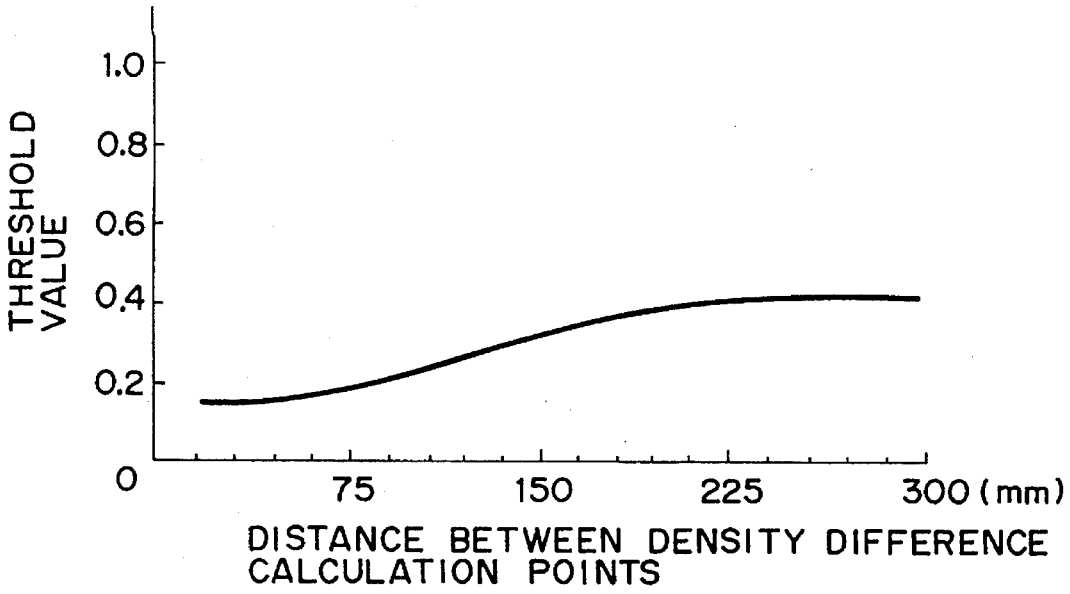
FIG. 35A is a chart showing the threshold value as a function of the position on the photosensitive member in the 5th embodiment.

Since the density difference is less conspicuous as the distance increases between the points used for calculating said density difference, the threshold value is selected larger as said distance increases, as shown in FIG. 35A. A density difference of ca. 0.4 is tolerated when said distance reaches 200 mm or larger.

Figure 34A:
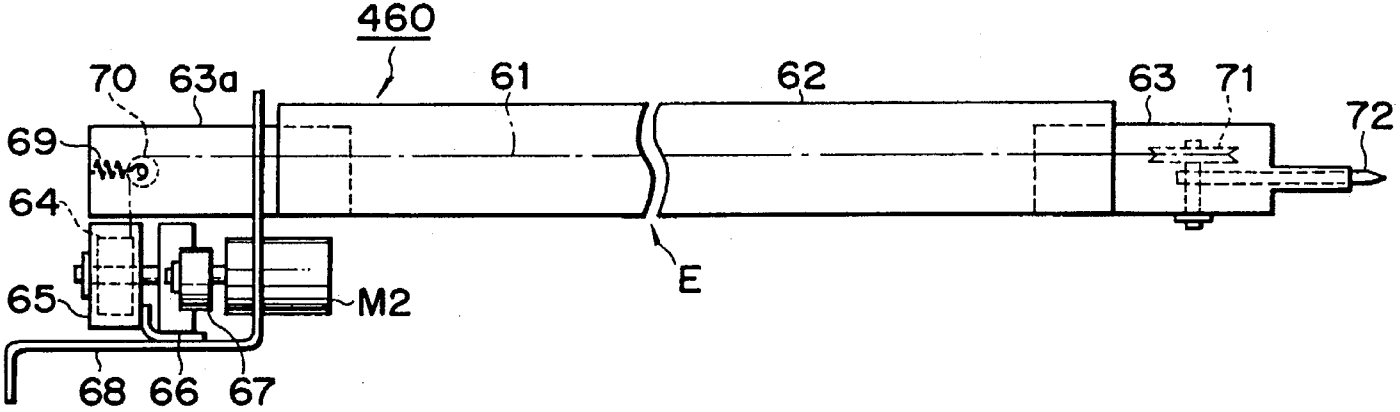
FIG. 34A is a front view of a corona charger with automatic wire replacing function, employed in the 5th embodiment.
Figure 34B:
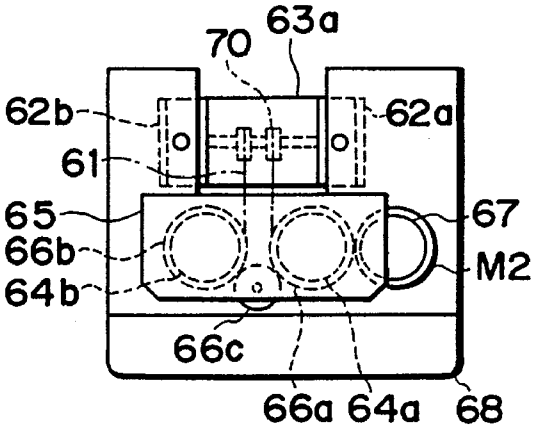
FIG. 34B is a lateral view thereof.

FIGS. 34A and 34B illustrate the corona charger 460 capable of automatically replacing the discharge wire, wherein shown are shield members 62*a*, 62*b* fixed on both ends to insulating blocks 63*a*, 63*b*; a wire deflecting pulley 70; a wire folding pulley 71 made of a metal material; an electrode 72 for applying a high voltage to the wire; a tension spring 69 for the wire; and a support plate 68 for fixing a wire feed/winding unit to the block 63*a*.

A gear 67 of a motor M2 meshes with a gear 66*a* of a pulley 64*a*, and said gear 66*a* also meshes with an intermediate gear 66*c* which in turn meshes with a gear 66*b* of a pulley 64*b*. A wire 61 would on the pulley 64*a* passes on the wire deflecting pulley 70 and the folding pulley 71, and is taken up on the pulley 64*b*.

When the discrimination turns out unacceptable as explained before, the motor M2 is rotated anticlockwise to rotate the feed pulley 64*a* through the gears 67, 66*a*, 66*c*, whereby the new wire 61 is pulled out to the discharge area E. At the same time the gear 66*b* is rotated clockwise through the intermediate gear 66*c*, whereby the used wire 61 is wound on the take-up pulley 64*b*. In this manner the wire 61 is automatically replaced. This corona charger 460 significantly reduces the work for wire replacement, but it is not completely maintenance-free because new wire has to be replenished when the wire on the pulley 64*a* runs out. The pulleys 64*a*, 64*b* are contained in a cassette case 65, and the case containing the used wire is replaced by another case containing a new wire.

[6th embodiment ]

Figure 35B:
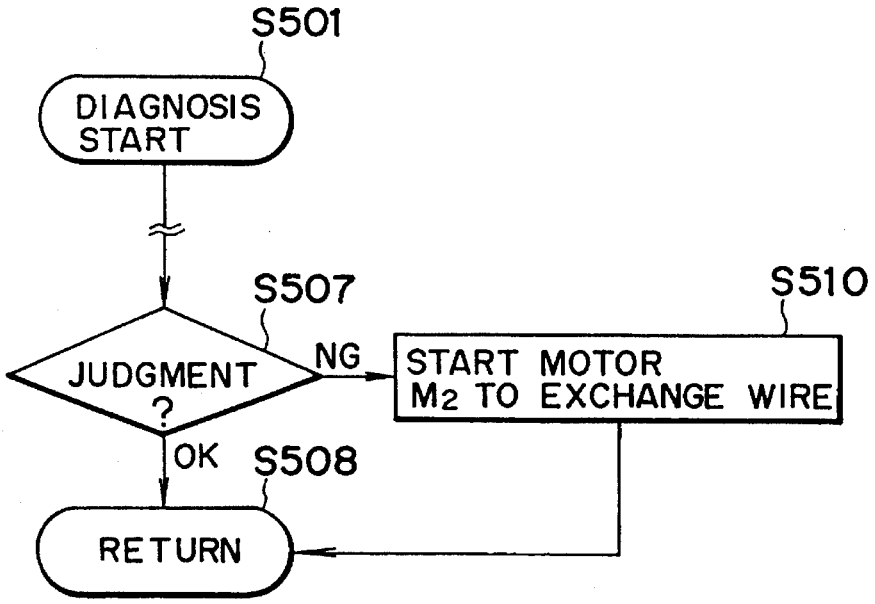
FIG. 35B is a flow chart of the control sequence of the 5th embodiment.

FIG. 35B is a flow chart showing the diagnostic process in a 6th embodiment, wherein the omitted steps S502 to S506 are substantially same as the steps S402–S406 in the 5th embodiment, except for the calculation method for density unevenness. If the result of discrimination in a step S507 is acceptable, the sequence proceeds to a step S508 as in the 5th embodiment, but, if said result is not acceptable, the sequence proceeds to a step S510 for sending a signal to the power source 422 of the wire replacing motor M2, thereby activating said motor M2 for a predetermined period and automatically replacing the wire.

In a continuous copying test conducted in a similar manner as in the 5th embodiment, with a copying machine incorporating the above-explained corona charger and employing the above-explained diagnostic method, the automatic wire replacement was executed at 190,000 copies, and the images immediately before said wire replacement did not show the density unevenness even over a long distance.

[7th embodiment ]

Figure 36A:
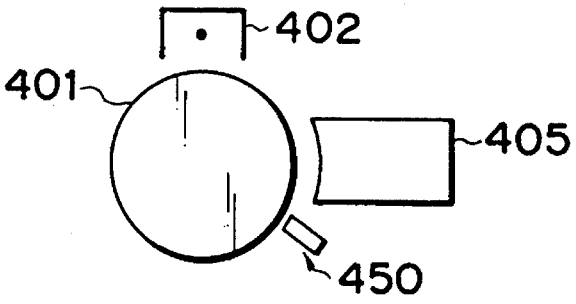
FIG. 36A is a partial view of a 6th embodiment.
Figure 36B:
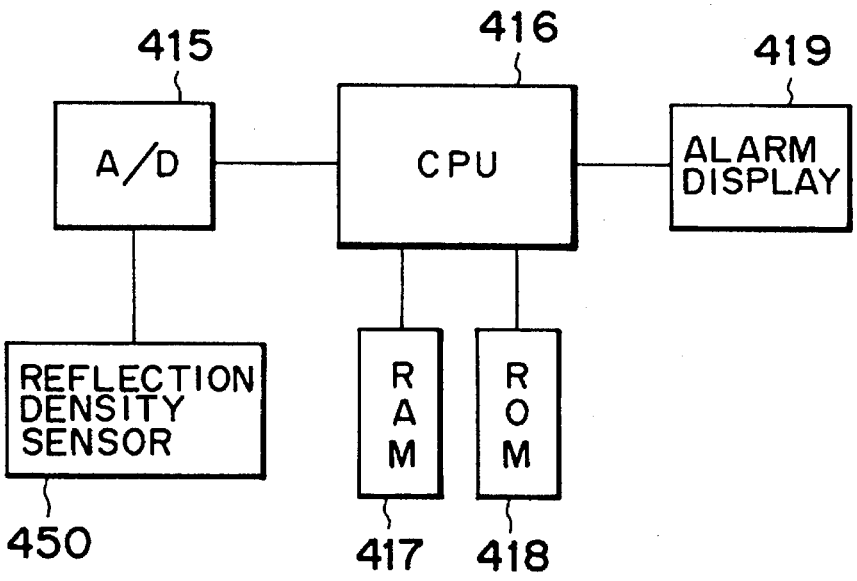
FIG. 36B is a block diagram of the principal circuit structure of said 6th embodiment.

In the following there will be explained a 7th embodiment with reference to FIGS. 36A and 36B, which are respectively a schematic view of structure and a block diagram of circuit. However the optical system and a part of the image forming units around the photosensitive member are omitted. In the present embodiment, the density distribution is determined by measuring the toner image density on the photosensitive member with a reflective density sensor 450 and entering the obtained results into a CPU 416 through an A/D converter 415.

The reflective density sensor 450 is of ordinary type consisting of an LED for illuminating the point to be measured and a photosensor for detecting the reflected light from said point, and is so constructed as to measure the density distribution of the toner image by a scanning motion in the axial direction of the photosensitive member, in a similar manner as the potential sensor explained before. Since the toner image shows a variation in the density in the procedure of transfer and fixing, correction is made before the density unevenness is discriminated.

Figure 37A:
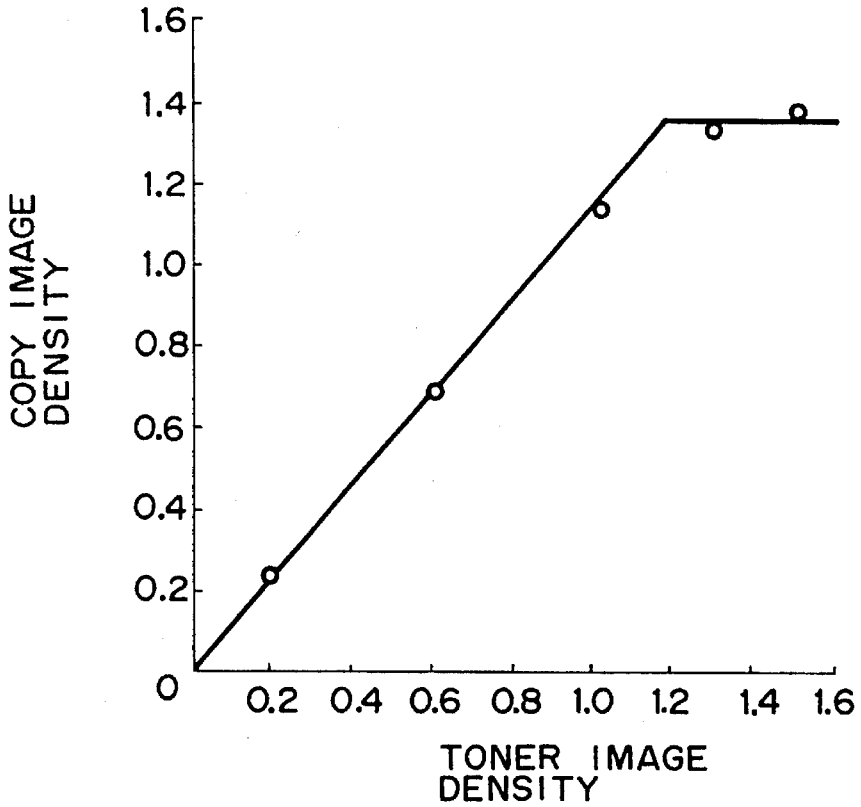
FIG. 37A is a chart showing the relation between the toner image density and the copy image denisty in the 6th embodiment.
Figure 37B:
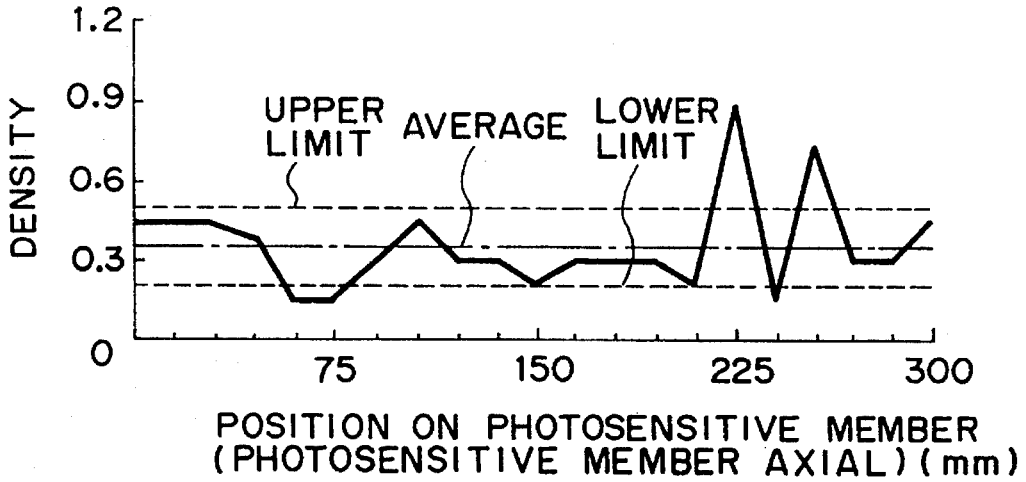
FIG. 37B is a chart showing the visible image density as a function of the position on the photosensitive member in the 6th embodiment.
Figure 38:
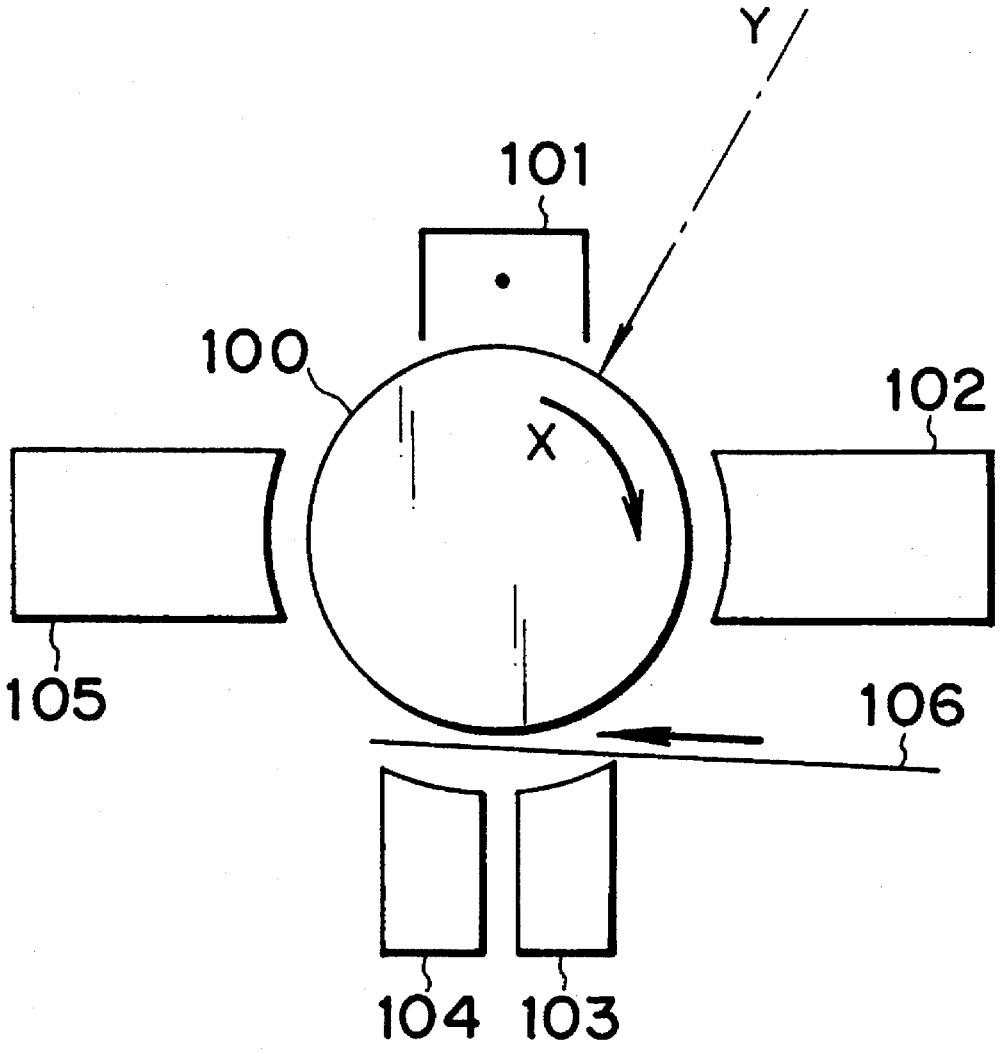
FIG. 38 is a schematic view of a conventional image forming apparatus.

FIG. 37A shows a curve for converting the toner image density into the copy image density, in order to effect said correction. Said curve is experimentally determined in advance and is stored in a ROM 418. FIG. 37B shows the method of discrimination, which is executed by setting upper and lower threshold values on both sides of the average value of the density distribution data obtained by the above-mentioned conversion, and by comparing the density distribution with said threshold values in the CPU 416. In the example shown in FIG. 37B, the average value is 0.36, the upper and lower limits are 0.36±0.15, and the result of discrimination indicates a non-acceptable state.

A continuous copying test with a copying machine incorporating the present diagnostic device provided results equivalent to those in the 5th embodiment.

The foregoing 4th to 6th embodiments have described the diagnostic device for the discharge unevenness in the corona discharge device for charging the photosensitive member, but such corona discharge device is frequently used as transfer or separating means as already known, and a similar diagnostic device can be designed for the discharge unevenness, similarly resulting from smears in the repeated discharges, in such corona discharge device for transfer or separation. Also such diagnostic device can be incorporated in the copying machine in which the units around the photosensitive member are constructed as a cartridge.

Also in said embodiments, there is provided either of the potential detecting means and the density detecting means, but both may be provided in combined manner.

As explained in the foregoing, the 4th to 6th embodiments allow to detect the unevenness in the potential or in the toner image density on the photosensitive member, resulting from uneven discharge caused by the smear of the discharge means, and to identify the timing of maintenance from the level of said unevenness. Also in case the necessity for maintenance is identified, an alarm therefor is given to the user, thereby preventing the deterioration of image quality caused by the uneven discharge or the abnormal discharge and enabling efficient maintenance work, thereby constantly providing satisfactory images and avoiding unnecessary consumption of discharge wire.

Furthermore, in case the maintenance is identified necessary, it is possible to take up the smeared wire and replenish with a new wire.

As explained in the foregoing, the present invention enables to detect abnormality in the image by measuring the potential or image density in plural positions on the image bearing member by means of potential measuring means or density measuring means, thereby providing an alarm for the abnormality in the image process means, or correcting the distribution of potential or image density.

The present invention is not limited by the foregoing embodiments, but is subject to various modifications within the scope and spirit of the appended claims.

What is claimed is:

1. An image forming apparatus comprising:

potential measuring means, movable in an axial direction perpendicular to a rotating direction of a photosensitive member, for measuring a potential of the photosensitive member;

density measuring means movable in said axial direction, for measuring an image density;

ability detection means for detecting an image forming ability in each of a latent image forming means and an image developing means, in accordance with an output of said potential measuring means and an output of said density measuring means;

control means for controlling an image forming condition in each of said latent image forming means and developing means; and abnormality detection means for detecting abnormality of the apparatus.

2. An image forming apparatus according to claim 1, wherein said potential and density measuring means measure an average of potential and an average density, respectively in the axial direction.

3. An image forming apparatus according to claim 2, wherein said control means controls said latent image forming means based on the average value of said potential.

4. An image forming apparatus according to claim 2, wherein said control means controls said developing means based on the average value of said density.

5. An image forming apparatus according to claim 1, wherein said potential and density measuring means measure a varying component of the potential and a varying component density, respectively in said axial direction.

6. An image forming apparatus according to claim 5, wherein said abnormality detection means detects abnormality in said latent image forming means when the varying component of the potential in said axial direction exceeds a predetermined value.

7. An image forming apparatus according to claim 5, wherein said abnormality detection means detects abnormality in said developing means when the varying component of the density in said axial direction exceeds a predetermined value.

8. An image forming apparatus according to claim 1, wherein said potential measuring means and said density measuring means measure a same position of said photosensitive member in the axial direction thereof.

9. An image forming apparatus comprising:

a photosensitive member;

plural process means for forming an image on said photosensitive member;

detection means for detecting, in an axial direction perpendicular to a rotating direction of said photosensitive member, both a potential of said photosensitive member and a density of an image formed on said photosensitive member; and control means for partially controlling a process amount of said process means, based on a distribution of both the detected potential of said photosensitive member in said axial direction and the detected density of said formed image.

10. An image forming apparatus according to claim 9, wherein said process means includes plural light-emitting elements arranged along said axial direction, and said control means adjusts an amount of light emitted by said plural light-emitting elements, according to said distribution.

11. An image forming apparatus provided with a pre-exposure device, a charging device, an exposure device and a development device around a rotated photosensitive member and adapted to form a latent image by exposing a surface of said photosensitive member after charging to a light from said exposure device and to develop said latent image with developer supplied from said development device, comprising:

a potential measurement device, movable in a direction crossing a moving direction of said photosensitive member, for measuring a surface potential of said photosensitive member;

a reflective density measurement device, movable in synchronization with said potential measurement device, in a direction crossing the moving direction of said photosensitive member, for measuring the reflective density of the surface of said photosensitive member; and a control device for regulating at least one of a charging potential of said charging device, developing condition of said development device, transfer condition of an image transfer device and amount of exposure by said pre-exposure device, based on signals from said potential measurement device and said reflective density measurement device.

12. An image forming apparatus according to claim 11, wherein said pre-exposure device includes plural light-emitting elements arranged in a direction crossing the moving direction of said photosensitive member, and regulates an amount of light emitted by said light emitting elements according to the signal from said potential measurement device or said reflective density measurement device.

13. An image forming apparatus comprising:

a photosensitive member;

plural process means for forming an image on said photosensitive member;

means for generating an electrical signal representing the image to be formed on said photosensitive member;

detection means for detecting an image forming ability of plural levels of test patches disposed in an axial direction perpendicular to a rotating direction of said photosensitive member; and correction means for correcting said electrical signal based on a distribution of the detected image forming ability within the plural levels of the test patches disposed in said axial direction.

14. An image forming apparatus according to claim 13, wherein said detection means measures a surface potential in said axial direction.

15. An image forming apparatus according to claim 13, wherein said detection means measures an image density in said axial direction.

16. An image forming apparatus according to claim 13, wherein said correction means effects gamma correction on said electrical signal, based on the image forming ability at said plural levels.

17. An image forming apparatus provided with a rotatably supported image bearing member, and electrostatic latent image forming means and image developing means positioned around said image bearing member, comprising:

a potential measurement device, positioned between said electrostatic latent image forming means and said image developing means, for measuring a surface potential on the periphery of said image bearing member;

a reflective density measurement device, positioned at a downstream side of said image developing means in a rotating direction of said image bearing member, for measuring a reflective density of a visible image formed by said image developing means;

measurement position varying means for rendering said potential measurement device and said reflective density measurement device movable in mutual synchronization along a direction of rotary axis of said image bearing member;

test pattern means for sending a predetermined signal to said electrostatic latent image forming means, in order to form a test pattern consisting of an electrostatic latent image on said image bearing member; and control means for calculating characteristics of said image bearing member, said electrostatic latent image forming means and said image developing means, based on a surface potential of said test pattern measured by said potential measurement device and the reflective density measured by said reflective density measurement device from a visible image of said test pattern, and controlling said electrostatic latent image forming means according to a result of said calculation.

18. An image forming apparatus according to claim 17, wherein said control means controls said electrostatic latent image forming means by converting density data based on a density of an original image.

19. An image forming apparatus according to claim 17, wherein said control means discriminates whether the result of measurement by said potential measurement device or said reflective density measurement device is within a predetermined range, and said apparatus further comprises alarm means for generating an alarm in response to a signal from said control means, in case the result of said measurement is outside said predetermined range.

20. An image forming apparatus according to claim 17, wherein said potential measurement device or said reflective density measurement device effects measurement in plural finer sections, in varying portion of an output, representing distribution in said axial direction, of said potential measurement device or said reflective density measurement device.

21. An image forming apparatus provided with a rotatably supported image bearing member, and electrostatic latent image forming means and image developing means positioned around said image bearing member, comprising:

a potential measurement device, positioned between said electrostatic latent image forming means and image developing means, for measuring a surface potential of a periphery area of said image bearing member;

a reflective density measurement device, positioned at a downstream side of said image developing means in a rotating direction of said image developing means in a rotating direction of said image bearing member, for measuring the reflective density of a visible image formed by said image developing means;

measurement position varying means for rendering said potential measurement device and said reflective density measurement device movable in mutual synchronization along a direction of rotary axis of said image bearing member;

test pattern means for sending a predetermined signal to said electrostatic latent image forming means, in order to form a test pattern consisting of a visible toner image on said image bearing member;

development portion selecting means for selecting an image developing area only in an axial position of said image bearing member, corresponding to the position of said potential measurement device and said reflective density measurement device; and control means for calculating characteristics of said electrostatic latent image forming means and said image developing means, based on the surface potential of said test pattern measured by said potential measurement device and the reflective density, measured by said reflective density measurement device, of the visible toner image developed from said test pattern on the image bearing member, and controlling said electrostatic latent image forming means according to a result of said calculation.

22. An image forming apparatus according to claim 21, wherein said control means controls said electrostatic latent image forming means by converting density data based on a density of an original image.

23. An image forming apparatus comprising:

a photosensitive member;

charging means for charging said photosensitive member, including a discharge member consisting of a conductive wire, a pulley for feeding an unused discharge member, a pulley for winding the used discharge member, and means for driving said pulleys;

exposure means for irradiating said photosensitive member, after charging, with a light image thereby forming a latent image thereon;

development means for developing said latent image;

detection means for detecting a distribution of the latent image in a direction perpendicular to a rotating direction of said photosensitive member or a density distribution of a developed image in said direction perpendicular to the rotating direction of the photosensitive member;

discrimination means for discriminating a necessity for maintenance for said charging means based on the distribution obtained from said detection means; and control means for activating said drive means when said discrimination means identifies the necessity for maintenance.

* * * * *

UNITED STATES PATENT AND TRADEMARK OFFICE

CERTIFICATE OF CORRECTION

PATENT NO. : 5,481,337

DATED : January 2, 1996

INVENTORS : Hiroaki Tsuchiya, et al.

It is certified that error appears in the above-identified patent and that said Letters Patent is hereby corrected as shown below:

ON THE TITLE PAGE:

Item [54], line 5, Title,"SELECTED" should read --DETECTED--.

COLUMN 2

Line 5, "SELECTED" should read --DETECTED--.

COLUMN 26

Line 16, "density difference between D2 and D3 ~ D20;" should read --density difference between D2 and D3 ~ D20; ..... --; and Line 17, "density difference between Di and Di1 ~ D20;" should read --density difference between Di and Di1 ~ D20; ..... --.

UNITED STATES PATENT AND TRADEMARK OFFICE

CERTIFICATE OF CORRECTION

PATENT NO. : 5,481,337

DATED : January 2, 1996

INVENTORS : Hiroaki Tsuchiya, et al.

It is certified that error appears in the above-identified patent and that said Letters Patent is hereby corrected as shown below:

COLUMN 30

Line 49, "varying" should read --a varying--.

Signed and Sealed this

Twenty-third Day of April, 1996

*Attest:*

*Attesting Officer*

BRUCE LEHMAN

*Commissioner of Patents and Trademarks*